US011120750B2

(12) United States Patent
Kim

(10) Patent No.: US 11,120,750 B2
(45) Date of Patent: Sep. 14, 2021

(54) STAGE AND SCAN DRIVER INCLUDING THE STAGE

(71) Applicant: Samsung Display Co., Ltd., Yongin-Si (KR)

(72) Inventor: Jong Hee Kim, Yongin-si (KR)

(73) Assignee: Samsung Display Co., Ltd.

( * ) Notice: Subject to any disclaimer, the term of this patent is extended or adjusted under 35 U.S.C. 154(b) by 0 days.

(21) Appl. No.: 16/912,633

(22) Filed: Jun. 25, 2020

(65) Prior Publication Data

US 2020/0410943 A1 Dec. 31, 2020

(30) Foreign Application Priority Data

Jun. 28, 2019 (KR) ..... 10-2019-0078331

(51) Int. Cl.
*G09G 3/3291* (2016.01)
*G09G 3/3258* (2016.01)

(52) U.S. Cl.
CPC ..... *G09G 3/3291* (2013.01); *G09G 3/3258* (2013.01); *G09G 2310/0291* (2013.01); *G09G 2310/08* (2013.01)

(58) Field of Classification Search
None
See application file for complete search history.

(56) References Cited

U.S. PATENT DOCUMENTS 8,654,158 B2 2/2014 Tsai et al.
8,957,882 B2 2/2015 Lee et al.
9,576,543 B2 2/2017 He
10,079,598 B2 9/2018 Park et al.
10,127,874 B2 11/2018 Park et al.
2016/0322116 A1* 11/2016 Jang ..... G09G 3/2092
2018/0337682 A1 11/2018 Takasugi et al.
2019/0164498 A1* 5/2019 Jang ..... G09G 3/3266
2020/0066203 A1 2/2020 Kim
2020/0219451 A1 7/2020 Kim
2020/0243018 A1 7/2020 Kim et al.

FOREIGN PATENT DOCUMENTS

KR 10-2016-0073928 A 6/2016
KR 10-2016-0117709 A 10/2016
KR 10-2016-0127211 A 11/2016
KR 10-1860732 B1 5/2018
KR 10-2018-0128123 A 12/2018
KR 10-2019-0009216 A 1/2019
KR 10-2020-0023563 A 3/2020
KR 10-2020-0085976 A 7/2020
KR 10-2020-0094895 A 8/2020

* cited by examiner

*Primary Examiner* — Christopher J Kohlman
(74) *Attorney, Agent, or Firm* — Innovation Counsel LLP

(57) ABSTRACT

The disclosure relates to a stage and a scan driver including the stage. The stage is connected to each of scan lines and supplies a scan signal and a sensing signal to the scan lines. The stage includes an input unit configured to control voltages of a first node and a second node based on a first control signal and a previous stage carry signal, and an output buffer including an eleventh node and a twelfth node electrically connected to the first node and the second node, respectively, in response to a second control signal, and configured to output a carry signal and the scan signal in response to a scan clock signal according to voltages of the eleventh node and the twelfth node and to output the sensing signal in response to a sensing clock signal.

20 Claims, 10 Drawing Sheets

STAGE AND SCAN DRIVER INCLUDING THE STAGE

The present application claims priority under 35 U.S.C. § 119(a) to Korean patent application number 10-2019-0078331 filed on Jun. 28, 2019, the disclosure of which is incorporated by reference herein its entirety.

BACKGROUND

1. Field

The disclosure relates to a stage and a scan driver including the stage.

2. Description of the Related Art

Display devices may include a pixel unit including a plurality of pixels, a scan driver, a data driver, a timing driver, and the like. The scan driver includes stages connected to scan lines, and the stages supply scan signals to the scan lines in response to signals from the timing controller.

Recent developments in the field allow a display device to perform driving that compensates deterioration and a characteristic change of a driving transistor outside a pixel circuit by sensing a threshold voltage or mobility of the driving transistor included in the pixel circuit. To this end, a scan driver may be configured to further supply a sensing signal through a sensing line.

Currently, the scan driver individually receives a clock signal for carry signal output control, a clock signal for scan signal output control, and a clock signal for sensing signal output control. In order to individually supply the clock signals, separate wires are required to be prepared in a display panel, which increases a bezel area of a display device.

SUMMARY

An object of the disclosure is to provide a stage configured to share a clock signal for carry signal output control and a clock signal scan signal output control, and a scan driver including the stage.

Another object of the disclosure is to provide a stage that receives a scan clock signal and a sensing clock signal and outputs a carry signal, a scan signal, and a sensing signal, and a scan driver including the stage.

A stage according to an embodiment of the disclosure may be connected to each of scan lines and to supply a scan signal and a sensing signal to the scan lines. The stage may include an input unit configured to control voltages of a first node and a second node based on a first control signal and a previous stage carry signal, and an output buffer including an eleventh node and a twelfth node electrically connected to the first node and the second node, respectively, in response to a second control signal, and configured to output a carry signal and the scan signal in response to a scan clock signal according to voltages of the eleventh node and the twelfth node and to output the sensing signal in response to a sensing clock signal. The output buffer may output the carry signal and the scan signal based on any one of the scan clock signal, a first low potential power voltage, and a second low potential power voltage, a low level of the scan clock signal may be set to be lower than or equal to the first low potential power voltage, and the second low potential power voltage may be set to be lower than or equal to the low level of the scan clock signal.

In addition, the output buffer may include a tenth transistor connected between a scan clock terminal configured to receive the scan clock signal and a first output terminal configured to output the scan signal, and having a gate electrode connected to the eleventh node, an eleventh transistor connected between the first output terminal and a first power terminal configured to receive the first low potential power voltage, and having a gate electrode connected to the twelfth node, and a twelfth transistor connected between a carry output terminal outputting the carry signal and the first output terminal, and having a gate electrode connected to the eleventh node.

In addition, the twelfth transistor may be turned on according to the voltage of the eleventh node and may output a part of signals output to the first output terminal to the carry output terminal.

In addition, the output buffer may include a carry output buffer configured to output the carry signal based on the scan clock signal and the first low potential power voltage, and a scan output buffer configured to output the scan signal based on the scan clock signal and the second low potential power voltage.

In addition, the low level of the scan clock signal may be set to be lower than the first low potential power voltage, and the second low potential power voltage may be set to be lower than the low level of the scan clock signal.

In addition, the scan output buffer may include a tenth transistor connected between a scan clock terminal configured to receive the scan clock signal and a first output terminal outputting the scan signal, and having a gate electrode connected to the eleventh node, and an eleventh transistor connected between the first output terminal and a first power terminal configured to receive the first low potential power voltage, and having a gate electrode connected to the twelfth node, and the carry output buffer may include a twelfth transistor connected between the scan clock terminal and a carry output terminal configured to output the carry signal, and having a gate electrode connected to the eleventh node, and a sixteenth transistor connected between the carry output terminal and the second low potential power voltage, and having a gate electrode connected to the twelfth node.

In addition, the scan output buffer and the carry output buffer may output the carry signal and the scan signal when the eleventh node is set to a high voltage.

In addition, the output buffer may further include a first transistor that is turned on when a fifth control signal is applied during a reset period of one frame and may supply the second low potential power voltage to the eleventh node.

In addition, when the low level of the scan clock signal is applied to the carry output terminal during a display period after the reset period, a first electrode voltage of the tenth transistor may be set to the low level, a second electrode voltage may be set to the first low potential power voltage, and a voltage of the gate electrode may be set to the voltage of the eleventh node.

In addition, the output buffer may further include a twenty-sixth transistor connected between the first node and the eleventh node, and having a gate electrode connected to a second input terminal configured to receive a second control signal, and a twenty-seventh transistor connected between the second node and the twelfth node, and having a gate electrode connected to the second input terminal, and the twenty-sixth transistor and the twenty-seventh transistor may be turned on by the second control signal and may electrically connect the eleventh node and the twelfth node to the first node and the second node, respectively.

In addition, the input unit may include a twenty-first transistor connected between a second carry input terminal configured to receive the previous stage carry signal and a third node, and having a gate electrode connected to a first input terminal configured to receive the first control signal, a twenty-second transistor connected between the third node and a third power terminal configured to receive a high potential power voltage, and having a gate electrode connected to a fourth node, a twenty-third transistor connected between the third node and the fourth node, and having a gate electrode connected to the first input terminal, a twenty-fourth transistor connected between the third power terminal and the first node, and having a gate electrode connected to the fourth node, a twenty-fifth transistor connected between the fourth node and a second power terminal configured to receive the second low potential power voltage, and having a gate electrode connected to the fourth node, and a capacitor connected between the third power terminal and the fourth node.

In addition, the twenty-first transistor, the twenty-second transistor, and the twenty-third transistor may be turned on and may supply a high voltage of the previous stage carry signal to the fourth node, when the first control signal is input.

In addition, the twenty-fourth transistor may supply the high potential power voltage to the first node as the twenty-fourth transistor is turned on in response to a voltage of the fourth node, and the twenty-fifth transistor may supply the first low potential power voltage to the second node as the twenty-fifth transistor is turned on in response to the voltage of the fourth node.

In addition, a scan driver according to an embodiment of the disclosure may include stages connected to scan lines respectively and to supply a scan signal and a sensing signal to the scan lines. An i-th (i is a natural number) stage may include an input unit configured to control voltages of a first node and a second node based on a first control signal and a previous stage carry signal, and an output buffer including an eleventh node and a twelfth node electrically connected to the first node and the second node, respectively, in response to a second control signal, and configured to output a carry signal and the scan signal in response to a scan clock signal according to voltages of the eleventh node and the twelfth node and to output the sensing signal in response to a sensing clock signal, the output buffer may output the carry signal and the scan signal based on any one of the scan clock signal, a first low potential power voltage, and a second low potential power voltage, a low level of the scan clock signal may be set to be lower than or equal to the first low potential power voltage, and the second low potential power voltage may be set to be lower than or equal to the low level of the scan clock signal.

In addition, the output buffer may include a tenth transistor connected between a scan clock terminal configured to receive the scan clock signal and a first output terminal configured to output the scan signal, and having a gate electrode connected to the eleventh node, an eleventh transistor connected between the first output terminal and the first low potential power voltage, and having a gate electrode connected to the twelfth node, and a twelfth transistor connected between a carry output terminal configured to output the carry signal and the first output terminal, and having a gate electrode connected to the eleventh node.

In addition, the twelfth transistor may be turned on according to the voltage of the eleventh node and may output a part of signals output to the first output terminal to the carry output terminal.

In addition, the output buffer may include a tenth transistor connected between a scan clock terminal configured to receive the scan clock signal and a first output terminal configured to output the scan signal, and having a gate electrode connected to the eleventh node, an eleventh transistor connected between the first output terminal and the first low potential power voltage, and having a gate electrode connected to the twelfth node, a twelfth transistor connected between the scan clock terminal and a carry output terminal configured to output the carry signal, and having a gate electrode connected to the eleventh node, and a sixteenth transistor connected between the carry output terminal and the second low potential power voltage, and having a gate electrode connected to the twelfth node.

In addition, the low level of the scan clock signal may be set to be lower than the first low potential power voltage, and the second low potential power voltage may be set to be lower than the low level of the scan clock signal.

In addition, the output buffer may further include a first transistor that is turned on when a fifth control signal is applied during a reset period of one frame and may supply the second low potential power voltage to the eleventh node.

In addition, when the low level of the scan clock signal is applied to the carry output terminal during a display period after the reset period, a first electrode voltage of the tenth transistor may be set to the low level, a second electrode voltage may be set to the first low potential power voltage, and a voltage of the gate electrode may be set to the voltage of the eleventh node.

The stage and the scan driver including the stage according to the embodiments of the disclosure are configured to share the clock signal for the carry signal output control and the clock signal for the scan signal output control. Therefore, the area consumed due to a clock signal wire may be minimized.

In addition, the stage and the scan driver including the stage according to the embodiments of the disclosure minimize crossing between wires by reducing the number of wires. As a result, a defect such as crosstalk generated at a crossing point between the wires may be reduced.

BRIEF DESCRIPTION OF THE DRAWINGS

The above and other features of the invention will become more apparent by describing in further detail exemplary embodiments thereof with reference to the accompanying drawings, in which.

DETAILED DESCRIPTION OF THE EMBODIMENT

Figure 1:
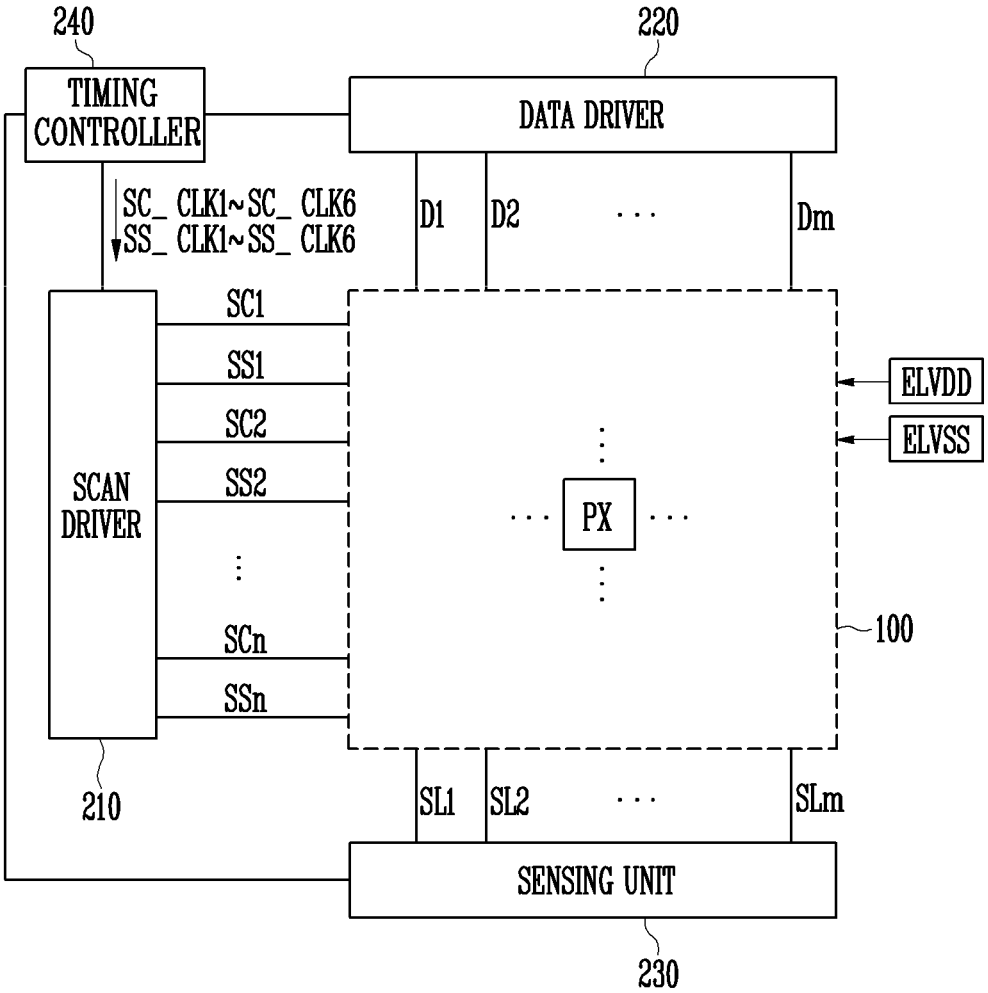
FIG. 1 is a block diagram illustrating a display device according to an embodiment of the disclosure.

The details of other embodiments are included in the detailed description and drawings.

The advantages and features of the disclosure and a method achieving them will become apparent with reference to the embodiments described in detail below with reference to the accompanying drawings. However, the disclosure is not limited to the embodiments described below, and may be embodied in various forms. In the following description, it is assumed that a case in which a part is connected to another part includes a case in which they are electrically connected to each other with another element interposed therebetween as well as a case in which they are directly connected to each other. In addition, in the drawings, parts which are not related to the disclosure are omitted for clarity of description, and like parts are denoted by the same reference numerals throughout the specification.

FIG. 1 is a block diagram illustrating a display device according to an embodiment of the disclosure.

Referring to FIG. 1, the display device according to an embodiment of the disclosure may include a display unit 100 including a plurality of pixels PX, a scan driver 210, a data driver 220, a sensing unit 230, and a timing controller 240.

The timing controller 240 may generate a scan driving control signal and a data driving control signal based on signals input from the outside. The scan driving control signal generated by the timing controller 240 may be supplied to the scan driver 210 and the data driving control signal may be supplied to the data driver 220.

The scan driving control signal may include a plurality of clock signals SC_CLK1 to SC_CLK6 and SS_CLK1 to SS_CLK6 and a scan start signal. The scan start signal may control an output timing of a first scan signal.

The plurality of clock signals SC_CLK1 to SC_CLK6 and SS_CLK1 to SS_CLK6 supplied from the scan driver 210 may include first to sixth scan clock signals SC_CLK1 to SC_CLK6 and first to sixth sensing clock signals SS_CLK1 to SS_CLK6. The first to sixth scan clock signals SC_CLK1 to SC_CLK6 may be used to shift the scan start signal. In addition, the first to sixth scan clock signals SC_CLK1 to SC_CLK6 may be used to output a scan signal in response to the scan start signal. The first to sixth sensing clock signals SS_CLK1 to SS_CLK6 may be used to output a sensing signal in response to the scanning start signal. In addition, the scan driver 210 may further receive a clock signal other than the clock signals SC_CLK1 to SC_CLK6 and SS_CLK1 to SS_CLK6 described above.

The data driving control signal may include a source start pulse and clock signals. The source start pulse may control a sampling start time of data, and the clock signals may be used to control a sampling operation.

The scan driver 210 may output the scan signals in response to the scan driving control signal. The scan driver 210 may sequentially supply the scan signals to first scan lines SC1 to SCn. Here, the scan signal may be set to a gate on voltage (for example, a voltage of a high level) so that transistors included in the pixels PX may be turned on.

The scan driver 210 may output the sensing signals in response to the scan driving control signal. The scan driver 210 may supply a sensing signal to at least one second scan line of second scan lines SS1 to SS2. Here, the sensing signal may be set to a gate on voltage (for example, a voltage of a high level) so that the transistors included in the pixels PX may be turned on.

The data driver 220 may supply data signals to data lines D1 to Dm in response to the data driving control signal. The data signals supplied to the data lines D1 to Dm may be supplied to the pixels PX to which the scan signals are supplied. To this end, the data driver 220 may supply the data signals to the data lines D1 to Dm in synchronization with the scan signal.

The sensing unit 230 may measure deterioration information of the pixels PX based on a current and/or a voltage fed back through sensing lines SL1 to SLm. Here, the pixels PX of which the deterioration information is measured through the sensing unit 230 may be pixels PX of a pixel column to which the sensing signal is supplied.

The deterioration information is characteristic of a driving transistor included in the pixel PX and may include a threshold voltage, mobility information, and the like of the driving transistor. In addition, the deterioration information may include information on a characteristic of a light emitting element included in the pixel PX. Although the sensing unit 230 is shown as a separate configuration in FIG. 1, the sensing unit 230 may be included in the data driver 220.

The display unit 100 may include the plurality of pixels PX connected to the data lines D1 to Dm, the first scan lines SC1 to SCn, the second scan lines SS1 to SSn, and the sensing lines SL1 to SLm.

The pixels PX may receive first power ELVDD and second power ELVSS from the outside.

Each of the pixels PX may receive the data signal from the data lines D1 to Dm when the scan signal is supplied to the first scan lines SC1 to SCn connected thereto during a display period. The pixel PX receiving the data signal may control an amount of current flowing from the first power ELVDD to the second power ELVSS via the light emitting element (not shown) corresponding to the data signal. At this time, the light emitting device may generate light of a predetermined luminance corresponding to the amount of current. The first power ELVDD may be set to a voltage higher than the second power ELVSS.

Each of the pixels PX may output a current and/or a voltage to the sensing lines SL1 to SLm based on the data signals supplied to the data lines D1 to Dm, when the sensing signals are supplied to the second scan lines SS1 to SSn connected thereto during a sensing period. The data signals supplied to the data lines D1 to Dm during the sensing period may be any reference data signals for sensing the pixel PX.

The number of the first scan lines SC1 to SCn connected to the pixel PX corresponding to a circuit structure of the pixel PX may be plural. In addition, in some cases, the pixel PX may be connected to a light emission control line in addition to the first scan lines SC1 to SCn and the data lines D1 to Dm. In this case, a light emission driver for outputting a light emission control signal may further be provided.

Figure 2:
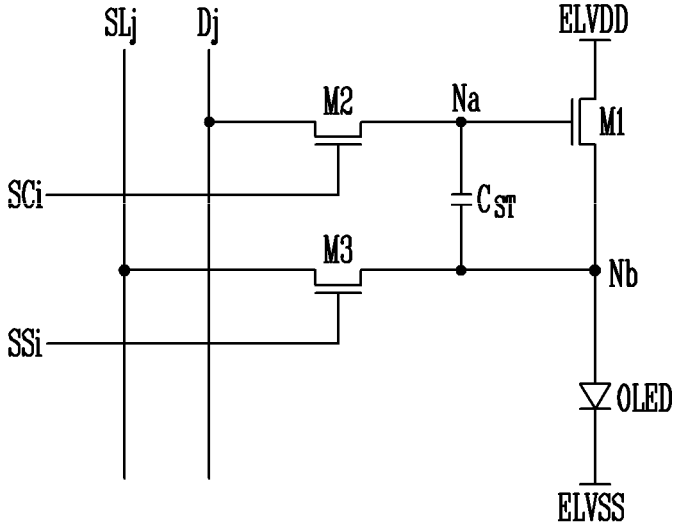
FIG. 2 is a circuit diagram illustrating an example of a pixel of FIG. 1.

FIG. 2 is a circuit diagram illustrating an example of the pixel of FIG. 1. In FIG. 2, for convenience of description, a pixel PX connected to an i-th first scan line SCi, an i-th second scan line SSi, a j-th sensing line SLj, and a j-th data line Dj is shown.

The pixel PX may include a driving transistor M1, a switching transistor M2, a sensing transistor M3, a storage capacitor Cst, and a light emitting element OLED. In various embodiments of the disclosure, the gate on voltage of the transistors M1, M2, and M3 provided in the pixel PX may be set to about 25 V and a gate off voltage may be set to about −5 V.

The switching transistor M2 may include a first electrode connected to the j-th data line Dj, a gate electrode connected to the i-th first scan line SCi, and a second electrode connected to a first node Na.

The switching transistor M2 may be turned on when the scan signal is supplied from the i-th first scan line SCi to supply the data signal received from the j-th data line Dj to the storage capacitor Cst. Alternatively, a potential of the first node Na may be controlled.

At this time, the storage capacitor Cst including a first electrode connected to the first node Na and a second electrode connected to a second node Nb may charge a voltage corresponding to the data signal.

The driving transistor M1 may include a first electrode connected to the first power ELVDD, a second electrode connected to the light emitting element OLED, and a gate electrode connected to the first node Na.

The driving transistor M1 may control the amount of current flowing through the light emitting element OLED in correspondence with a gate-source voltage value.

The sensing transistor M3 may include a first electrode connected to the j-th sensing line SLj, a second electrode connected to the second node Nb, and a gate electrode connected to the i-th second scan line SSi. The sensing transistor M3 may be turned on when the sensing signal is supplied to the i-th second scan line SSi to control a potential of the second node Nb. Alternatively, when the sensing signal is supplied to the i-th second scan line SSi, the sensing transistor M3 may be turned on to measure the current flowing through the light emitting element OLED.

The light emitting element OLED may include a first electrode (anode electrode) connected to the second electrode of the driving transistor M1 and a second electrode (cathode electrode) connected to the second power ELVSS. The light emitting element OLED may generate light corresponding to the amount of current supplied from the driving transistor M1.

In FIG. 2, the first electrode of the transistors M1 to M3 may be set as one of a source electrode and a drain electrode, and the second electrode of the transistors M1 to M3 may be set as an electrode different from the first electrode. For example, when the first electrode is set as the source electrode, the second electrode may be set as the drain electrode.

In addition, the transistors M1 to M3 may be NMOS transistors as shown in FIG. 2.

While mobility of the driving transistor M1 is sensed, an activated scan signal is supplied to the i-th first scan line SCi and an activated sensing signal is supplied to the second scan line SSi. However, in order to sense the current flowing through the light emitting element OLED to obtain the deterioration information, the driving transistor M1 is required to be turned off and the sensing transistor M3 is required to be turned on. That is, while sensing the current flowing through the light emitting element OLED, a deactivated signal is required to be applied to the i-th first scan line SCi and an activated signal is required to be applied to the second scan line SSi. Therefore, the scan signal supplied to the i-th first scan line SCi and the sensing signal supplied to the second scan line SSi are required to be separately supplied.

Figure 3:
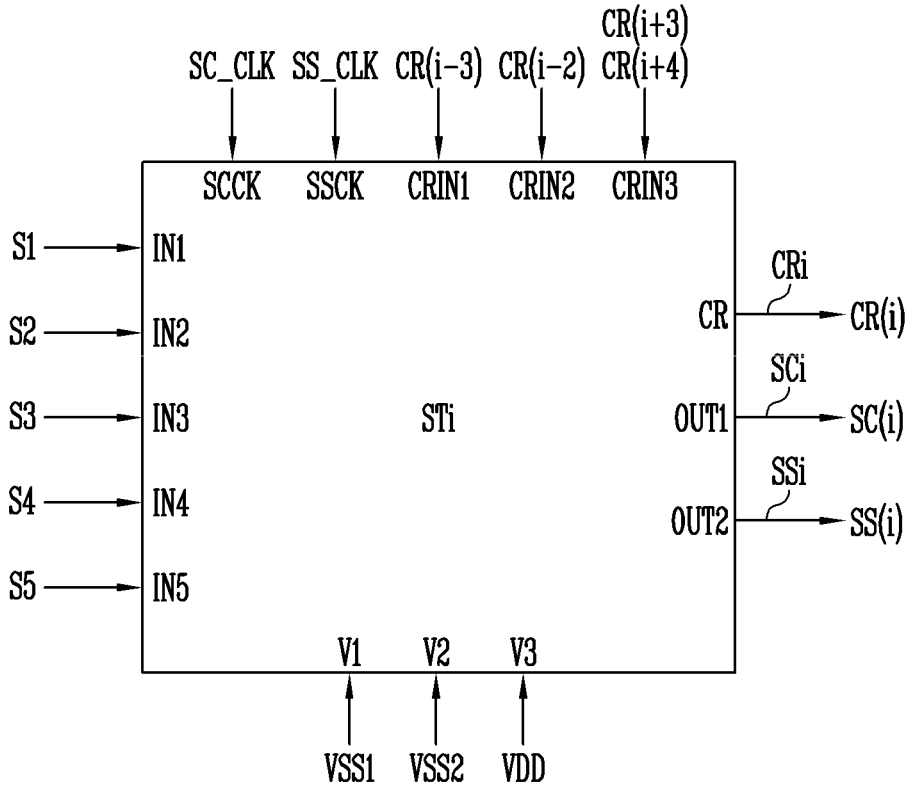
FIG. 3 is a diagram schematically illustrating a stage shown in FIG. 1.

FIG. 3 is a diagram schematically illustrating a stage shown in FIG. 1. In FIG. 3, for convenience of description, only an i-th stage is exemplarily shown.

A stage STi outputs a scan signal SC(i) to the i-th first scan line SCi and outputs a sensing signal SS(i) to the i-th second scan line SSi in response to input signals. The stage STi may include first to fifth input terminals IN1 to IN5, a scan clock terminal SCCK, a sensing clock terminal SSCK, first to third carry input terminals CRIN1 to CRIN3, and first to third power terminals V1 to V3. In addition, the stage STi may include a carry output terminal CR, a first output terminal OUT1, and a second output terminal OUT2.

The first to fifth input terminals IN1 to IN5 may receive first to fifth control signals S1 to S5, respectively. The first to fifth control signals S1 to S5 may be global signals supplied from the timing controller 240 to control the outputs of the scan signal SC(i) and the sensing signal SS(i).

In various embodiments, a gate on voltage of the first to fifth control signals S1 to S5 is a voltage capable of turning on the transistors provided in the stage STi, and for example, the gate on voltage may be set to 25 V when the transistors provided in the stage STi are n-type transistors. On the contrary, a gate off voltage of the first to fifth control signals S1 to S5 is a voltage capable of turning off the transistors provided in the stage STi, and for example, the gate off voltage may be set to about −5 V when the transistors provided in the stage STi are n-type transistors. However, the embodiments of the disclosure are not limited thereto. In one embodiment, the gate on/off voltage of the transistors provided in the stage STi may be the same as the gate on/off voltage of the transistors M1, M2, and M3 provided in the pixel PX of FIG. 2.

In ones embodiment, a third control signal S3 and a fourth control signal S4 may be alternately supplied to the stages. For example, when the third control signal S3 is supplied to the i-th stage STi, the fourth control signal S4 may be supplied to an (i+1)-th stage STi+1. In such an embodiment, the fourth input terminal IN4 of the i-th stage STi may be deactivated or not provided and the third input terminal IN3 of the (i+1)-th stage STi+1 may be deactivated or not provided.

The scan clock terminal SCCK may receive any one of the first to sixth scan clock signals SC_CLK1 to SC_CLK6. The first to sixth scan clock signals SC_CLK1 to SC_CLK6 may have a logic high level and a logic low level. Here, the logic high level corresponds to the gate on voltage, and the logic low level may be set to be equal to or lower than the gate off voltage. For example, when the gate on voltage of the transistors provided in the stage STi is about 25 V, the logic high level may be about 25 V, and when the gate off voltage of the transistors provided in the stage STi is about −5 V, the logic low level may be about −5 to −7 V.

In an embodiment, a gate on voltage period of the first to sixth scan clock signals SC_CLK1 to SC_CLK6 may be about two horizontal periods (2H). In addition, a gate on voltage period of the i-th scan clock signal and the (i+1)-th scan clock signal may overlap for about one horizontal period (1H). However, this is an example, and the gate on voltage period of the first to sixth scan clock signals SC_CLK1 to SC_CLK6 may be set to be shorter than two horizontal periods (2H). In addition, the number of scan clock signals supplied to one stage is not limited thereto.

The scan clock signal input to the scan clock terminal SCCK may have a gate on voltage synchronized with the scan signal SC(i). For example, in a sensing period in one frame, the scan clock signal input to the scan clock terminal SCCK may have a gate on voltage while the mobility and the threshold voltage of the drive transistor are sensed.

The sensing clock terminal SSCK may receive any one of the first to sixth sensing clock signals SS_CLK1 to SS_CLK6. The first to sixth sensing clock signals SS_CLK1 to SS_CLK6 may have a logic high level and a logic low level. Here, the logic high level may correspond to the gate on voltage, and the logic low level may correspond to the gate off voltage or lower than the gate off voltage. For example, the logic high level may be about 25V, and the logic low level may be about −5 V to −7 V.

In an embodiment, a gate on voltage period of the first to sixth sensing clock signals SS_CLK1 to SS_CLK6 may be about two horizontal periods (2H). In addition, a gate on voltage period of the i-th sensing clock signal and the (i+1)-th sensing clock signal may overlap for about one horizontal period (1H). However, this is an example, and the gate on voltage period of the first to sixth sensing clock signals SS_CLK1 to SS_CLK6 may be set to be shorter than two horizontal periods (2H). In addition, the number of sensing clock signals supplied to one stage is not limited thereto.

The sensing clock signal input to the sensing clock terminal SSCK may have a gate on voltage synchronized with the sensing signal SS(i). For example, the sensing clock signal input to the sensing clock terminal SSCK during a sensing period in one frame may maintain the gate on voltage. In an embodiment, the sensing clock signal SS_CLK input to the sensing clock terminal SSCK during a display period in one frame may have a waveform synchronized with the scan clock signal SC_CLK input to the scan clock terminal SCCK.

The first to third carry input terminals CRIN1 to CRIN3 receive a carry signal output from a previous stage and/or a subsequent stage. For example, the first carry input terminal CRIN1 may receive a carry signal CR(i−3) of an (i−3)-th stage, and the second carry input terminal CRIN2 may receive a carry signal CR(i−2) of an (i−2)-th stage, and the third carry input terminal CRIN3 may receive a carry signal CR(i+4) of an (i+4)-th stage. However, in another embodiment of the disclosure, the third carry input terminal CRIN3 may receive a carry signal CR(i+3) of an (i+3)-th stage.

The first power terminal V1 may receive a voltage of first power VSS1, the second power terminal V2 may receive a voltage of second power VSS2, and the third power terminal V3 may receive a voltage of a third power VDD. The third power VDD may be set to the gate on voltage and the first power VSS1 and the second power VSS2 may be set to a level lower than the voltage of the third power VDD. For example, the third power VDD may be set to about 25V, and the first power VSS1 and the second power VSS2 may be set to a voltage lower than about 25V. In the disclosure, the first power VSS1 may be set to the gate off voltage of the first to sixth scan clock signals SC_CLK1 to SC_CLK6, and for example, the first power VSS1 may be about −5 V. In addition, in the disclosure, the second power VSS2 may be set to a voltage equal to or lower than the logic low level of the first to sixth scan clock signals SC_CLK1 to SC_CLK6, and for example, the second power VSS2 may be about −7 to −9 V.

The carry output terminal CR may output a carry signal CR(i). The first output terminal OUT1 may output the scan signal SC(i). The second output terminal OUT2 may output the sensing signal SS(i).

The above-described stage STi of the disclosure does not receive a clock signal supplied from the timing controller 240 in comparison with a general stage. Instead, the stage STi according to the disclosure is configured to use the scan clock signal instead of the clock signal and output the carry signal CR(i) based on the scan clock signal. A detailed configuration of the stage STi according to the disclosure will be described in detail with reference to the drawing.

Figure 4:
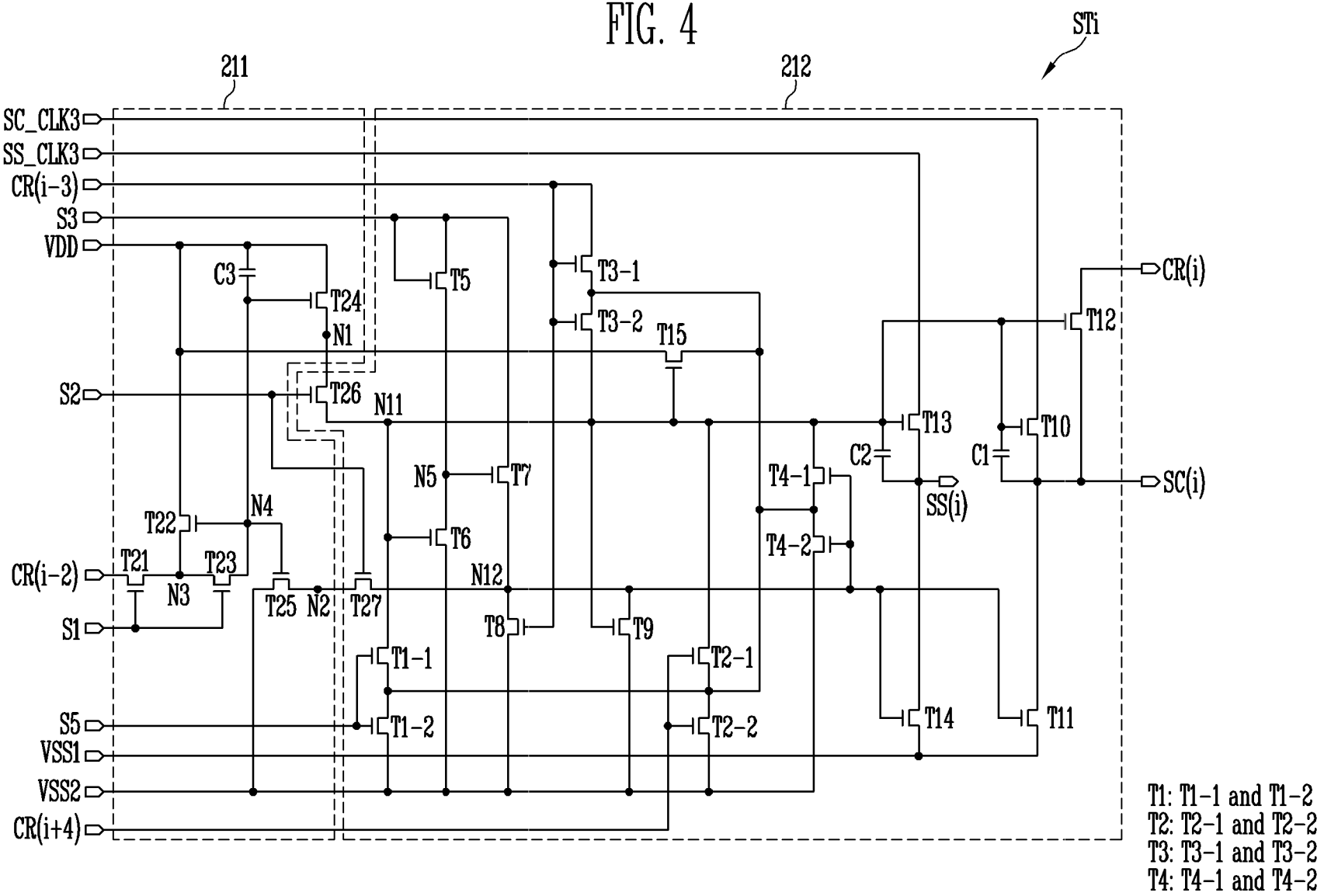
FIG. 4 is a circuit diagram illustrating an embodiment of the stage shown in FIG. 3.

FIG. 4 is a circuit diagram illustrating an embodiment of the stage shown in FIG. 3. In FIG. 4, for convenience of description, only one stage STi is exemplarily shown. In addition, hereinafter, for convenience of description, it is assumed that a fact that a certain signal is supplied means that a high voltage is supplied and a fact that a certain signal is not supplied means that a low voltage is supplied.

In addition, in FIG. 4, a stage STi receiving a third scan clock signal SC_CLK3 and a third sensing clock signal SS_CLK3 is representatively shown. In describing FIG. 4, the third scan clock signal SC_CLK3 is referred to as the scan clock signal, and the third sensing clock signal SS_CLK3 is referred to as the sensing clock signal.

Referring to FIGS. 3 and 4, the stage STi according to an embodiment of the disclosure may include an input unit 211 and an output buffer 212. The input unit 211 may include twenty-first to twenty-seventh transistors T21 to T27 and a third capacitor C3. In addition, the output buffer 212 includes first to fifteenth transistors T1 to T15 and first and second capacitors C1 and C2.

A configuration of the input unit 211 will be described first as follows.

A first electrode of the third capacitor C3 is connected to a third power terminal V3 to which the third power VDD is input and a second electrode is connected to a gate electrode of the twenty-fourth transistor T24 (that is, a fourth node N4). The third capacitor C3 stores a voltage corresponding to the gate electrode of the twenty-fourth transistor T24. Here, for example, the third power VDD may be set as the gate on voltage.

The twenty-first transistor T21 is connected between a third node N3 and a second carry input terminal CRIN2 to which an (i−2)-th carry signal CR(i−2) is input. A gate electrode of the twenty-first transistor T21 is connected to a first input terminal IN1 to which a first control signal S1 is input. The twenty-first transistor T21 may be turned on when the first control signal S1 is supplied to supply a voltage corresponding to the (i−2)-th carry signal CR(i−2) to the third node N3.

The twenty-second transistor T22 is connected between the third node N3 and the third power terminal V3 to which the third power VDD is input. A gate electrode of the twenty-second transistor T22 is connected to the fourth node N4. The twenty-second transistor T22 is turned on or off in response to a voltage of the fourth node N4.

The twenty-third transistor T23 is connected between the third node N3 and the fourth node N4. A gate electrode of the twenty-third transistor T23 is connected to the first input terminal IN1 to which the first control signal S1 is input. The twenty-third transistor T23 is turned on when the first control signal S1 is supplied to supply a voltage of the third node N3 to the fourth node N4.

The twenty-fourth transistor T24 is connected between the third power terminal V3 to which the third power VDD is input and the first node N1. A gate electrode of the twenty-fourth transistor T24 is connected to the fourth node N4. The twenty-fourth transistor T24 is turned on or off in response to the voltage of the fourth node N4. When the twenty-fourth transistor T24 is turned on, the high voltage of the third power VDD is supplied to the first node N1.

The twenty-fifth transistor T25 is connected between the second power terminal V2 to which the second power VSS2 is input and the second node N2. A gate electrode of the twenty-fifth transistor T25 is connected to the fourth node N4. The twenty-fifth transistor T25 is turned on or off in response to the voltage of the fourth node N4. When the twenty-fifth transistor T25 is turned on, the low voltage of the second power VSS2 is supplied to the second node N2. Here, the second power VSS2 may be a voltage that is set to be lower than the third power VDD, and may be set to be lower than the gate off voltage. In an embodiment, the second power VSS2 may be set to be lower than the first power VSS1, and may be about −7 to −9 V.

The output buffer 212 is connected to the input unit 211 through the first node N1 and the second node N2.

The first transistor T1 may include a (1-1)-th transistor T1-1 and a (1-2)-th transistor T1-2. The (1-1)-th transistor T1-1 and the (1-2)-th transistor T1-2 are connected in series between an eleventh node N11 and the second power terminal V2 to which the second power VSS2 is input. Gate electrodes of the (1-1)-th transistor T1-1 and the (1-2)-th transistor T1-2 are connected to a fifth input terminal IN5 to which a fifth control signal S5 is input. The (1-1)-th transistor T1-1 and the (1-2)-th transistor T1-2 may be turned on when the fifth control signal S5 is supplied to set a voltage of the eleventh node N11 to the voltage of the second power VSS2.

The second transistor T2 may include a (2-1)-th transistor T2-1 and a (2-2)-th transistor T2-2. The (2-1)-th transistor T2-1 and the (2-2)-th transistor T2-2 are connected in series between the eleventh node N11 and the second power terminal V2 to which the second power VSS2 is input. Gate electrodes of the (2-1)-th transistor T2-1 and the (2-2)-th transistor T2-2 are connected to the third carry input terminal CRIN3 to which the (i+4)-th carry signal CR(i+4) or the (i+3)-th carry signal CR(i+3) is input. The (2-1)-th transistor T2-1 and the (2-2)-th transistor T2-2 may be turned on when the (i+4)-th carry signal CR(i+4) or the (i+3)-th carry signal CR(i+3) is supplied to set the voltage of the eleventh node N11 to the voltage of the second power VSS2.

The third transistor T3 may include a (3-1)-th transistor T3-1 and a (3-2)-th transistor T3-2. The (3-1)-th transistor T3-1 and the (3-2)-th transistor T3-2 are connected in series between the eleventh node N11 and the first carry input terminal CRIN1 to which an (i−3)-th carry signal CR(i−3) is input. Gate electrodes of the (3-1)-th transistor T3-1 and the (3-2)-th transistor T3-2 are connected to the first carry input terminal CRIN1. The (3-1)-th transistor T3-1 and the (3-2)-th transistor T3-2 may be turned on when the (i−3)-th carry signal CR(i−3) is supplied to supply the (i−3)-th carry signal CR(i−3) to the eleventh node N11.

The fourth transistor T4 may include a (4-1)-th transistor T4-1 and a (4-2)-th transistor T4-2. The (4-1)-th transistor T4-1 and the (4-2)-th transistor T4-2 are connected in series between the eleventh node N11 and the second power terminal V2 to which the second power VSS2 is input. Gate electrodes of the (4-1)-th transistor T4-1 and the (4-2)-th transistor T4-2 are connected to a twelfth node N12. The (4-1)-th transistor T4-1 and the (4-2)-th transistor T4-2 are turned on or off in response to power of the twelfth node N12. When the (4-1)-th transistor T4-1 and the (4-2)-th transistor T4-2 are turned on, the voltage of the second power VSS2 may be supplied to the eleventh node N11.

The fifth transistor T5 is diode-connected between the third input terminal IN3 receiving the third control signal S3 and a gate electrode of the seventh transistor T7 (that is, a fifth node N5). The fifth transistor T5 may be connected in a diode form when the third control signal S3 is supplied to supply the third control signal S3 to the fifth node N5.

The sixth transistor T6 is connected between the fifth node N5 and the second power terminal V2 to which the second power VSS2 is input. A gate electrode of the sixth transistor T6 is connected to the eleventh node N11. The sixth transistor T6 may be turned on when the eleventh node N11 is set to the high voltage to supply the voltage of the second power VSS2 to the fifth node N5.

The seventh transistor T7 is connected between the third input terminal IN3 to which the third control signal S3 is input and the twelfth node N12. The gate electrode of the seventh transistor T7 is connected to the fifth node N5. The seventh transistor T7 is turned on or off in response to a voltage of the fifth node N5. As the seventh transistor T7 is turned on, a voltage of the third control signal S3 may be supplied to the twelfth node N12.

The eighth transistor T8 is connected between the twelfth node N12 and the second power terminal V2 to which the second power VSS2 is input. A gate electrode of the eighth transistor T8 is connected to the first carry input terminal CRIN1 to which the (i−3)-th carry signal CR(i−3) is input. The eighth transistor T8 may be turned on when the (i−3)-th carry signal CR(i−3) is supplied to set the voltage of the twelfth node N12 to the low voltage of the second power VSS2.

The ninth transistor T9 is connected between the twelfth node N12 and the second power terminal V2 to which the second power VSS2 is input. A gate electrode of the ninth transistor T9 is connected to the eleventh node N11. The ninth transistor T9 may be turned on when the high voltage is supplied to the eleventh node N11 to set the voltage of the twelfth node N12 to the low voltage of the second power VSS2.

The tenth transistor T10, the eleventh transistor T11, and the first capacitor C1 operate as a buffer circuit for outputting the scan signal SC(i).

The tenth transistor T10 is connected between the scan clock terminal SCCK to which the scan clock signal SC_CLK3 is input and a first output terminal OUT1 outputting the scan signal SC(i). A gate electrode of the tenth transistor T10 is connected to the eleventh node N11. The tenth transistor T10 may be turned on when the eleventh node N11 is set to the high voltage to output the scan clock signal SC_CLK3 as the scan signal SC(i).

Here, the scan clock signal SC_CLK3 may have a logic high level and a logic low level. Here, the logic high level may correspond to the gate on voltage, and the logic low level may correspond to the gate off voltage or lower than the gate off voltage. For example, the logic high level may be about 25 V. For example, when the gate off voltage is about −5 V, the logic low level may be about −5 to −7 V.

The eleventh transistor T11 is connected between the first output terminal OUT1 and the first power terminal V1 receiving the first power VSS1. A gate electrode of the eleventh transistor T11 is connected to the twelfth node N12. The eleventh transistor T11 may be turned on or off in response to the voltage of the twelfth node N12. As the eleventh transistor T11 is turned on, the low voltage of the first power VSS1 may be output as the scan signal SC(i). Here, the first power VSS1 may be a voltage that is set to be lower than the third power VDD, and for example, the first power VSS1 may be set to the gate off voltage. In an embodiment, the first power VSS1 may be set to the gate off voltage and may be about −5 V.

The first capacitor C1 is connected between the first output terminal OUT1 and the eleventh node N11.

The twelfth transistor T12 operates as a buffer circuit for outputting the carry signal CR(i). The twelfth transistor T12 is connected between the carry output terminal CR outputting the carry signal CR(i) and the first output terminal OUT1 outputting the scan signal SC(i). A gate electrode of the twelfth transistor T12 is connected to the eleventh node N11. The twelfth transistor T12 may be turned on when the eleventh node N11 is set to the high voltage to output a part of a current flowing to the first output terminal OUT1 as the carry signal CR(i).

The thirteenth transistor T13, the fourteenth transistor T14, and the second capacitor C2 operate as a buffer circuit for outputting the sensing signal SS(i).

The thirteenth transistor T13 is connected between the sensing clock terminal SSCK receiving the sensing clock signal SS_CLK3 and a second output terminal OUT2 outputting the sensing signal SS(i). A gate electrode of the thirteenth transistor T13 is connected to the eleventh node N11. The thirteenth transistor T13 may be turned on when the eleventh node N11 is set to the high voltage to output the sensing clock signal SS_CLK3 as the sensing signal SS(i).

The fourteenth transistor T14 is connected between the second output terminal OUT2 and the first power terminal V1 receiving the first power VSS1. A gate electrode of the fourteenth transistor T14 is connected to the twelfth node N12. The fourteenth transistor T14 may be turned on or off in response to the voltage of the twelfth node N12. As the fourteenth transistor T14 is turned on, the low voltage of the first power VSS1 may be output as the sensing signal SS(i).

The second capacitor C2 is connected between the second output terminal OUT2 and the eleventh node N11.

One end of the fifteenth transistor T15 is connected to a common electrode of the (1-1)-th transistor T1-1 and the (1-2)-th transistor T1-2, a common electrode of the (2-1)-th transistor T2-1 and the (2-2)-th transistor T2-2, a common electrode of the (3-1)-th transistor T3-1 and the (3-2)-th transistor T3-2, and a common electrode of the (4-1)-th transistor T4-1 and the (4-2)-th transistor T4-2. The other end of the fifteenth transistor T15 is connected to the third power terminal V3 to which the third power VDD is input. A gate electrode of the fifteenth transistor T15 is connected to the eleventh node N11. The fifteenth transistor T15 is turned on or off in response to the voltage of the eleventh node N11.

Figure 5:
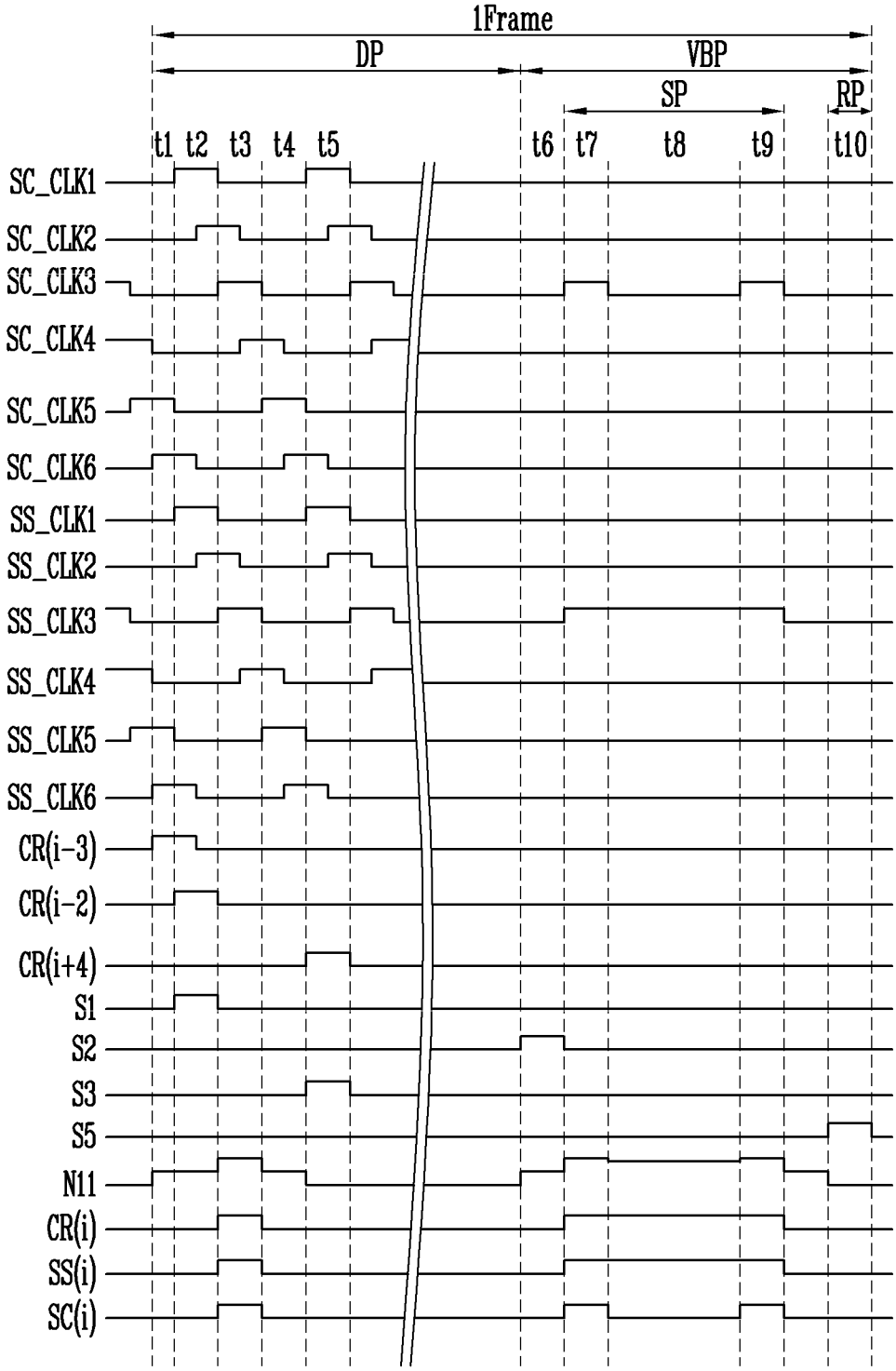
FIG. 5 is a waveform diagram illustrating an embodiment of a method of driving the stage shown in FIG. 4.
Figure 6:
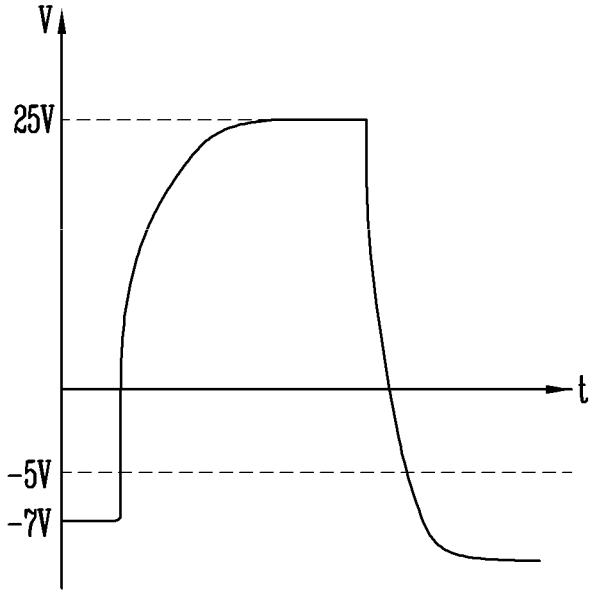
FIG. 6 is a waveform diagram illustrating an example of a scan clock signal applied to the stage shown in FIG. 4.

FIG. 5 is a waveform diagram illustrating an embodiment of a method of driving the stage shown in FIG. 4. FIG. 6 is a waveform diagram illustrating an example of the scan clock signal applied to the stage shown in FIG. 4.

FIG. 5 shows an example in which sensing is performed on an i-th pixel column during a sensing period. Here, the i-th pixel column is connected to the i-th stage STi receiving the third scan clock signal SC_CLK3 and the third sensing clock signal SS_CLK3. Here, the i-th stage STi may be configured to receive the third control signal S3 and not to receive the fourth control signal S4.

In addition, referring to FIG. 5, one frame period 1Frame may include a display period DP and a vertical blank period VBP, and the vertical blank period VBP may include a sensing period SP and a reset period RP.

Referring to FIGS. 4 and 5, as the (i−3)-th carry signal CR(i−3) is supplied in synchronization with the sixth scan clock signal SC_CLK6 in a first period t1, the (3-1)-th transistor T3-1 and the (3-2)-th transistor T3-2 may be turned on. Then, the high voltage of the (i−3)-th carry signal CR(i−3) may be supplied to the eleventh node N11, and the eleventh node N11 may be set to the high voltage.

When the eleventh node N11 is set to the high voltage, the tenth transistor T10, the twelfth transistor T12, and the thirteenth transistor T13 are turned on. However, since the third scan clock signal SC_CLK3 and the third sensing clock signal SS_CLK3 are not supplied during the first period t1, the carry signal CR(i), the scan signal SC(i), and the sensing signal SS(i) are not output.

In addition, as the (i−3)-th carry signal CR(i−3) is supplied in the first period t1, the eighth transistor T8 may be turned on. Then, the low voltage of the second power VSS2 may be supplied to the twelfth node N12, and thus the twelfth node N12 may be set to the low voltage.

The (i−2)-th carry signal CR(i−2) and the first control signal S1 are supplied to the input unit 211 in synchronization with the first scan clock signal SC_CLK1 in a second period t2. As the first control signal S1 is supplied, the twenty-first transistor T21 and the twenty-third transistor T23 of the i-th stage STi are turned on. When the twenty-first transistor T21 and the twenty-third transistor T23 are turned on, the high voltage of the (i−2)-th carry signal CR(i−2) is supplied to the fourth node N4. When the high voltage is supplied to the fourth node N4, the twenty-second transistor T22, the twenty-fourth transistor T24, and the twenty-fifth transistor T25 are turned on.

When the twenty-second transistor T22 is turned on, the high voltage of the third power VDD may be supplied to the third node N3, and thus the high voltage of the third node N3 may be stably maintained.

When the twenty-fourth transistor T24 is turned on, the high voltage of the third power VDD is supplied to the first node N1, and thus the first node N1 is set to the high voltage. At this time, the third capacitor C3 stores the high voltage of the fourth node N4.

When the twenty-fifth transistor T25 is turned on, the low voltage of the second power VSS2 is supplied to the second node N2, and thus the second node N2 is set to the low voltage.

The first control signal S1 may be selectively supplied to a stage connected to a pixel column to be sensed in a subsequent sensing period SP to set the voltages of the first node N1 and the second node N2 to the high voltage and the low voltage, respectively.

Meanwhile, since the second control signal S2 is not supplied during the second period t2, the twenty-sixth transistor T26 and the twenty-seventh transistor T27 maintain a turn-off state, and voltage control of the first node N1 and the second node N2 does not affect the voltages of the eleventh node N11 and the twelfth node N12. Therefore, during the second period t2, the eleventh node N11 and the twelfth node N12 may maintain voltages of a previous period (for example, the eleventh node N11 may maintain the high voltage and the twelfth node N12 may maintain the low voltage).

The third scan clock signal SC_CLK3 and the third sensing clock signal SS_CLK3 are supplied to the stage STi in a third period t3. At this time, as the eleventh node N11 is maintained at the high voltage, since the tenth transistor T10, the twelfth transistor T12, and the thirteenth transistor T13 maintain a turn-on state, the carry signal CR(i), the scan signal SC(i), and the sensing signal SS(i) are output.

During the third period t3, the voltage of the eleventh node N11 may be set to a voltage higher than that in the first period t1 by coupling of the first capacitor C1 and the second capacitor C2.

When the supply of the third scan clock signal SC_CLK3 and the third sensing clock signal SS_CLK3 is stopped in the fourth period t4, the output of the carry signal CR(i), the scan signal SC(i), and the sensing signal SS(i) is stopped, and the voltage of the eleventh node N11 may be returned to the voltage in the first period t1.

When the supply of the third scan clock signal SC_CLK3 is stopped, the third scan clock signal SC_CLK3 may transition from the high voltage to the low voltage. Ideally, a polling edge when the third scan clock signal SC_CLK3 transition from the high voltage to the low voltage is vertical, but in practice it may have a downwardly curved shape substantially as shown in FIG. 6.

When the logic low level of the third scan clock signal SC_CLK3 is set to be the same as the gate off voltage of the transistors M1, M2, and M3 provided in the pixel PX, the transistors M1, M2, and M3 may be turned off when the third scan clock signal SC_CLK 3 completely transition from the high voltage to the low voltage. However, when the logic low level of the third scan clock signal SC_CLK3 is set to be lower than the gate off voltage of the transistors M1, M2, and M3 provided in the pixel PX as in the disclosure, even before the scan signal SC_CLK3 completely transition from the high voltage to the low voltage, when the third scan clock signal SC_CLK3 reaches a gate low voltage value, the transistors M1, M2, and M3 provided in the pixel PX may be turned off.

Therefore, the stage STi according to the disclosure may advance a turn-off timing of the transistors M1, M2, and M3 in the pixel PX connected to the stage STi, and thus a driving delay that may occur in an actual operation may be prevented and a problem that a leak current is generated through the transistors M1, M2, and M3 in the pixel PX or a voltage may not be sufficiently charged due to a turn-off delay may be solved.

As the (i+4)-th carry signal CR(i+4) is supplied in synchronization with the first scan clock signal SC_CLK1 in a fifth period t5, the (2-1)-th transistor T2-1 and the (2-2)-th transistor T2-2 may be turned on. Then, the low voltage of the second power VSS2 may be supplied to the eleventh node N11, and the eleventh node N11 may be set to the low voltage.

In addition, as the third control signal S3 is supplied in the fifth period t5, the fifth transistor T5 may be diode-connected to set the fifth node N5 to the high voltage. Then, the seventh transistor T7 may be turned on, the third control signal S3 may be supplied to the twelfth node N12, and the twelfth node N12 may be set to the high voltage. Then, the low voltage of the first power VSS1 may be output as the scan signal SC(i), the sensing signal SS(i), and the carry signal CR(i) through the eleventh transistor T11, the fourteenth transistor T14, and the twelfth transistor T12.

The second control signal S2 is supplied to the stage STi in a sixth period t6. As the second control signal S2 is supplied, the twenty-sixth transistor T26 and the twenty-seventh transistor T27 are turned on.

When the twenty-sixth transistor T26 is turned on, the high voltage of the first node N1 is supplied to the eleventh node N11. When the eleventh node N11 is set to the high voltage, the tenth transistor T10, the twelfth transistor T12, and the thirteenth transistor T13 are turned on. Since the third scan clock signal SC_CLK3 and the third sensing clock signal SS_CLK3 are not supplied in the sixth period t6, the carry signal CR(i), the scan signal SC(i), and the sensing signal SS(i)) are not output.

When the twenty-seventh transistor T27 is turned on, the low voltage of the second node N2 may be supplied to the twelfth node N12, and thus the twelfth node N12 may be set to the low voltage.

The first node N1 is set to the high voltage only in the stage receiving the first control signal S1 in the second period t2. Therefore, the eleventh node N11 may be set to the high voltage and the twelfth node N12 may be set to the low voltage in the sixth period t6.

The second control signal S2, the third scan clock signal SC_CLK3, and the third sensing clock signal SS_CLK3 are supplied to the stage STi in a seventh period t7. At this time, since the eleventh node N11 is set to the high voltage, the tenth transistor T10 and the thirteenth transistor T13 are maintained in the turn-on state, and the scan signal SC(i) and the sensing signal SS(i) are output. The characteristic (for example, the threshold voltage, the mobility, and the like) of the driving transistor provided in the pixel PX receiving the scan signal SC(i) and the sensing signal SS(i) may be measured.

At this time, the twelfth transistor T12 may also maintain the turn-on state, and thus a part of the current output to the first output terminal OUT1 may be output as the carry signal CR(i). The carry signal CR(i) output from the stage STi during the sensing period SP may be applied to the first to third carry input terminals CRIN1 to CRIN3 of the next stage or the previous stage. Then, the voltage of the eleventh node N11 of the next stage or the previous stage may be set to the high voltage. However, since the scan clock signal SC_CLK and the sensing clock signal SS_CLK are not supplied to the next stage or the previous stage, an unacceptable scan signal and sensing signal are not output from the next stage and the previous stage. Therefore, the carry signal and the scan signal may be controlled by the same scan clock signal SC_CLK. As a result, the scan driver 210 does not have a separate clock signal for controlling the carry signal output, and thus a wire for the clock signal may be reduced.

The voltage of the eleventh node N11 during the seventh period t7 may be set to a voltage higher than that in the sixth period t6 by the coupling of the first capacitor C1 and the second capacitor C2.

The supply of the sensing clock signal SS_CLK3 to the stage STi is stopped in the eighth period t8. Then, the output of the sensing signal SS(i) is stopped and the voltage of the eleventh node N11 may be set to a voltage that is somewhat lower than that in the seventh period t7 as the coupling of the first capacitor C1 is released.

A characteristic of an organic light emitting diode provided in the pixel PX may be measured during an eighth period t8.

The scan clock signal SC_CLK3 and the sensing clock signal SS_CLK3 are supplied to the stage STi in a ninth period t9, and thus the scan signal SC(i) and the sensing signal SS(i) are output. In addition, the carry signal CR(i) may be output during the ninth period t9.

In an embodiment, the data signal of a corresponding frame may be supplied to the pixel PX during the ninth period t9, and the driving transistor may be initialized.

The fifth control signal S5 is supplied to the stage STi during a tenth period t10. Therefore, the (1-1)-th transistor T1-1 and the (1-2)-th transistor T1-2 are turned on, and the voltage of the eleventh node N11 is initialized as the low voltage of the second power VSS2.

Figure 7:
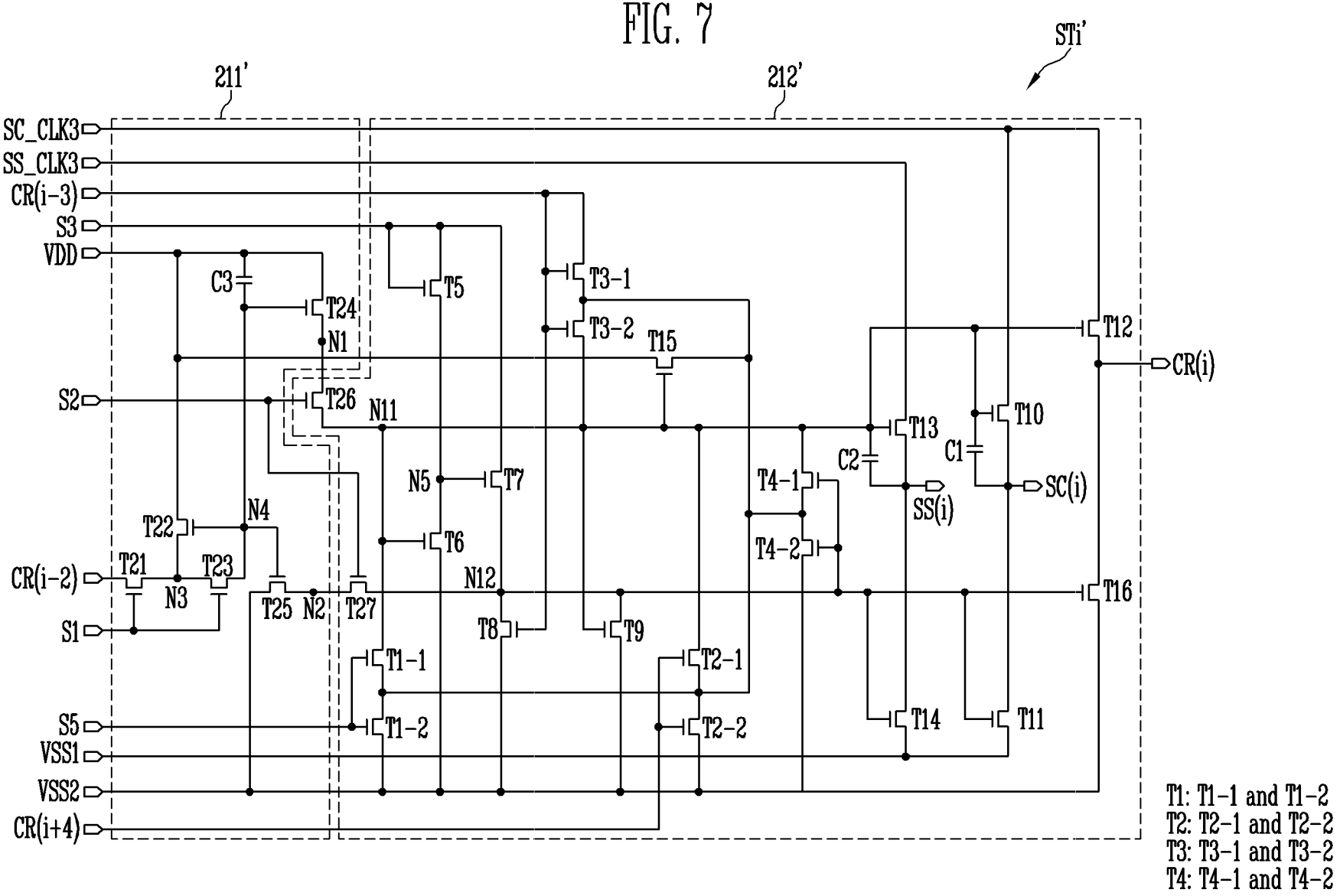
FIG. 7 is a circuit diagram illustrating another embodiment of the stage shown in FIG. 3.

FIG. 7 is a circuit diagram illustrating another embodiment of the stage shown in FIG. 3. In FIG. 7, for convenience of description, only one stage STi' is exemplarily shown. In addition, hereinafter, for convenience of description, it is assumed that a fact that a certain signal is supplied means that a high voltage is supplied and a fact that a certain signal is not supplied means that a low voltage is supplied.

In addition, in FIG. 7, a stage STi' receiving a third scan clock signal SC_CLK3 and a third sensing clock signal SS_CLK3 is representatively shown. In describing FIG. 7, the third scan clock signal SC_CLK3 is referred to as the scan clock signal, and the third sensing clock signal SS_CLK3 is referred to as the sensing clock signal.

Referring to FIGS. 3 and 7, the stage STi' according to another embodiment of the disclosure may include an input unit 211' and an output buffer 212'. The input unit 211' may include twenty-first to twenty-seventh transistors T21 to T27 and a third capacitor C3. In addition, the output buffer 212' includes first to sixteenth transistors T1 to T16 and first and second capacitors C1 and C2.

A configuration of the input unit 211' will be described first as follows.

A first electrode of the third capacitor C3 is connected to a third power terminal V3 to which the third power VDD is input and a second electrode is connected to a gate electrode of the twenty-fourth transistor T24 (that is, a fourth node N4). The third capacitor C3 stores a voltage corresponding to the gate electrode of the twenty-fourth transistor T24. Here, for example, the third power VDD may be set to the gate on voltage.

The twenty-first transistor T21 is connected between a second carry input terminal CRIN2 to which an (i−2)-th carry signal CR(i−2) is input and a third node N3. A gate electrode of the twenty-first transistor T21 is connected to a first input terminal IN1 to which a first control signal S1 is input. The twenty-first transistor T21 may be turned on when the first control signal S1 is supplied to supply a voltage corresponding to the (i−2)-th carry signal CR(i−2) to the third node N3.

The twenty-second transistor T22 is connected between the third node N3 and the third power terminal V3 to which the third power VDD is input. A gate electrode of the twenty-second transistor T22 is connected to the fourth node N4. The twenty-second transistor T22 is turned on or off in response to a voltage of the fourth node N4.

The twenty-third transistor T23 is connected between the third node N3 and the fourth node N4. A gate electrode of the twenty-third transistor T23 is connected to the first input terminal IN1 to which the first control signal S1 is input. The twenty-third transistor T23 is turned on when the first control signal S1 is supplied to supply a voltage of the third node N3 to the fourth node N4.

The twenty-fourth transistor T24 is connected between the third power terminal V3 to which the third power VDD is input and the first node N1. A gate electrode of the twenty-fourth transistor T24 is connected to the fourth node N4. The twenty-fourth transistor T24 is turned on or off in response to the voltage of the fourth node N4. When the twenty-fourth transistor T24 is turned on, the high voltage of the third power VDD is supplied to the first node N1.

The twenty-fifth transistor T25 is connected between the second power terminal V2 to which the second power VSS2 is input and the second node N2. A gate electrode of the twenty-fifth transistor T25 is connected to the fourth node N4. The twenty-fifth transistor T25 is turned on or off in response to the voltage of the fourth node N4. When the twenty-fifth transistor T25 is turned on, the low voltage of the second power VSS2 is supplied to the second node N2. Here, the second power VSS2 may be a voltage that is set to be lower than the third power VDD, and may be set to be lower than the gate off voltage. In an embodiment, the second power VSS2 may be set to be lower than the first power VSS1 and the low level of the scan clock signal SC_CLK3, and may be about −9 V.

The output buffer 212' is connected to the input unit 211' through the first node N1 and the second node N2.

The first transistor T1 may include a (1-1)-th transistor T1-1 and a (1-2)-th transistor T1-2. The (1-1)-th transistor T1-1 and the (1-2)-th transistor T1-2 are connected in series between an eleventh node N11 and the second power terminal V2 to which the second power VSS2 is input. Gate electrodes of the (1-1)-th transistor T1-1 and the (1-2)-th transistor T1-2 are connected to a fifth input terminal IN5 to which a fifth control signal S5 is input. The (1-1)-th transistor T1-1 and the (1-2)-th transistor T1-2 may be turned on when the fifth control signal S5 is supplied to set a voltage of the eleventh node N11 to the voltage of the second power VSS2.

The second transistor T2 may include a (2-1)-th transistor T2-1 and a (2-2)-th transistor T2-2. The (2-1)-th transistor T2-1 and the (2-2)-th transistor T2-2 are connected in series between the eleventh node N11 and the second power terminal V2 to which the second power VSS2 is input. Gate electrodes of the (2-1)-th transistor T2-1 and the (2-2)-th transistor T2-2 are connected to the third carry input terminal CRIN3 to which the (i+4)-th carry signal CR(i+4) or the (i+3)-th carry signal CR(i+3) is input. The (2-1)-th transistor T2-1 and the (2-2)-th transistor T2-2 may be turned on when the (i+4)-th carry signal CR(i+4) or the (i+3)-th carry signal CR(i+3) is supplied to set the voltage of the eleventh node N11 to the voltage of the second power VSS2.

The third transistor T3 may include a (3-1)-th transistor T3-1 and a (3-2)-th transistor T3-2. The (3-1)-th transistor T3-1 and the (3-2)-th transistor T3-2 are connected in series between the eleventh node N11 and the first carry input terminal CRIN1 to which an (i−3)-th carry signal CR(i−3) is input. Gate electrodes of the (3-1)-th transistor T3-1 and the (3-2)-th transistor T3-2 are connected to the first carry input terminal CRIN1. The (3-1)-th transistor T3-1 and the (3-2)-th transistor T3-2 may be turned on when the (i−3)-th carry signal CR(i−3) is supplied to supply the (i−3)-th carry signal CR(i−3) to the eleventh node N11.

The fourth transistor T4 may include a (4-1)-th transistor T4-1 and a (4-2)-th transistor T4-2. The (4-1)-th transistor T4-1 and the (4-2)-th transistor T4-2 are connected in series between the eleventh node N11 and the second power terminal V2 to which the second power VSS2 is input. Gate electrodes of the (4-1)-th transistor T4-1 and the (4-2)-th transistor T4-2 are connected to a twelfth node N12. The (4-1)-th transistor T4-1 and the (4-2)-th transistor T4-2 are turned on or off in response to power of the twelfth node N12. When the (4-1)-th transistor T4-1 and the (4-2)-th transistor T4-2 are turned on, the voltage of the second power VSS2 may be supplied to the eleventh node N11.

The fifth transistor T5 is diode-connected between the third input terminal IN3 receiving the third control signal S3 and a gate electrode of the seventh transistor T7 (that is, a fifth node N5). The fifth transistor T5 may be connected in a diode form when the third control signal S3 is supplied to supply the third control signal S3 to the fifth node N5.

The sixth transistor T6 is connected between the fifth node N5 and the second power terminal V2 to which the second power VSS2 is input. A gate electrode of the sixth transistor T6 is connected to the eleventh node N11. The sixth transistor T6 may be turned on when the eleventh node N11 is set to the high voltage to supply the voltage of the second power VSS2 to the fifth node N5.

The seventh transistor T7 is connected between the third input terminal IN3 to which the third control signal S3 is input and the twelfth node N12. The gate electrode of the seventh transistor T7 is connected to the fifth node N5. The seventh transistor T7 is turned on or off in response to a voltage of the fifth node N5. As the seventh transistor T7 is turned on, a voltage of the third control signal S3 may be supplied to the twelfth node N12.

The eighth transistor T8 is connected between the twelfth node N12 and the second power terminal V2 to which the second power VSS2 is input. A gate electrode of the eighth transistor T8 is connected to the first carry input terminal CRIN1 to which the (i−3)-th carry signal CR(i−3) is input. The eighth transistor T8 may be turned on when the (i−3)-th carry signal CR(i−3) is supplied to set the voltage of the twelfth node N12 to the low voltage of the second power VSS2.

The ninth transistor T9 is connected between the twelfth node N12 and the second power terminal V2 to which the second power VSS2 is input. A gate electrode of the ninth transistor T9 is connected to the eleventh node N11. The ninth transistor T9 may be turned on when the high voltage is supplied to the eleventh node N11 to set the voltage of the twelfth node N12 to the low voltage of the second power VSS2.

The tenth transistor T10, the eleventh transistor T11, and the first capacitor C1 operate as a buffer circuit for outputting the scan signal SC(i).

The tenth transistor T10 is connected between the scan clock terminal SCCK to which the scan clock signal SC_CLK3 is input and a first output terminal OUT1 outputting the scan signal SC(i). A gate electrode of the tenth transistor T10 is connected to the eleventh node N11. The tenth transistor T10 may be turned on when the eleventh node N11 is set to the high voltage to output the scan clock signal SC_CLK3 as the scan signal SC(i).

Here, the scan clock signal SC_CLK3 may have a logic high level and a logic low level. Here, the logic high level corresponds to the gate on voltage, and the logic low level is set to be lower than the gate off voltage. For example, the logic high level may be about 25 V. For example, when the gate off voltage is about −5 V, the logic low level may be about −7 V.

The eleventh transistor T11 is connected between the first output terminal OUT1 and the first power terminal V1 receiving the first power VSS1. A gate electrode of the eleventh transistor T11 is connected to the twelfth node N12. The eleventh transistor T11 may be turned on or off in response to the voltage of the twelfth node N12. As the eleventh transistor T11 is turned on, the low voltage of the first power VSS1 may be output as the scan signal SC(i). Here, the first power VSS1 may be a voltage that is set to be lower than the third power VDD, and for example, the first power VSS1 may be set to the gate off voltage. In an embodiment, the first power VSS1 may be set to the gate off voltage and may be about −5 V.

The first capacitor C1 is connected between the first output terminal OUT1 and the eleventh node N11.

The twelfth transistor T12 and the sixteenth transistor T16 operate as a buffer circuit for outputting the carry signal CR(i).

The twelfth transistor T12 is connected between the scan clock terminal SCCK to which the scan clock signal SC_CLK3 is input and the carry output terminal CR outputting the carry signal CR(i). A gate electrode of the twelfth transistor T12 is connected to the eleventh node N11. The twelfth transistor T12 may be turned on when the eleventh node N11 is set to the high voltage to output the scan clock signal SC_CLK3 as the carry signal CR(i).

The sixteenth transistor T16 is connected between the carry output terminal CR and the second power terminal V2 receiving the second power VSS2. A gate electrode of the sixteenth transistor T16 is connected to the twelfth node N12. The sixteenth transistor T16 may be turned on or off in response to the voltage of the twelfth node N12. As the sixteenth transistor T16 is turned on, the low voltage of the second power VSS2 may be output as the carry signal CR(i).

The thirteenth transistor T13, the fourteenth transistor T14, and the second capacitor C2 operate as a buffer circuit for outputting the sensing signal SS(i).

The thirteenth transistor T13 is connected between the sensing clock terminal SSCK receiving the sensing clock signal SS_CLK and a second output terminal OUT2 outputting the sensing signal SS(i). A gate electrode of the thirteenth transistor T13 is connected to the eleventh node N11. The thirteenth transistor T13 may be turned on when the eleventh node N11 is set to the high voltage to output the sensing clock signal SS_CLK as the sensing signal SS(i).

The fourteenth transistor T14 is connected between the second output terminal OUT2 and the first power terminal V1 receiving the first power VSS1. A gate electrode of the fourteenth transistor T14 is connected to the twelfth node N12. The fourteenth transistor T14 may be turned on or off in response to the voltage of the twelfth node N12. As the fourteenth transistor T14 is turned on, the low voltage of the first power VSS1 may be output as the sensing signal SS(i).

The second capacitor C2 is connected between the second output terminal OUT2 and the eleventh node N11.

One end of the fifteenth transistor T15 is connected to a common electrode of the (1-1)-th transistor T1-1 and the (1-2)-th transistor T1-2, a common electrode of the (2-1)-th transistor T2-1 and the (2-2)-th transistor T2-2, a common electrode of the (3-1)-th transistor T3-1 and the (3-2)-th transistor T3-2, and a common electrode of the (4-1)-th transistor T4-1 and the (4-2)-th transistor T4-2. The other end of the fifteenth transistor T15 is connected to the third power terminal V3 to which the third power VDD is input. A gate electrode of the fifteenth transistor T15 is connected to the eleventh node N11. The fifteenth transistor T15 is turned on or off in response to the voltage of the eleventh node N11.

Figure 8:
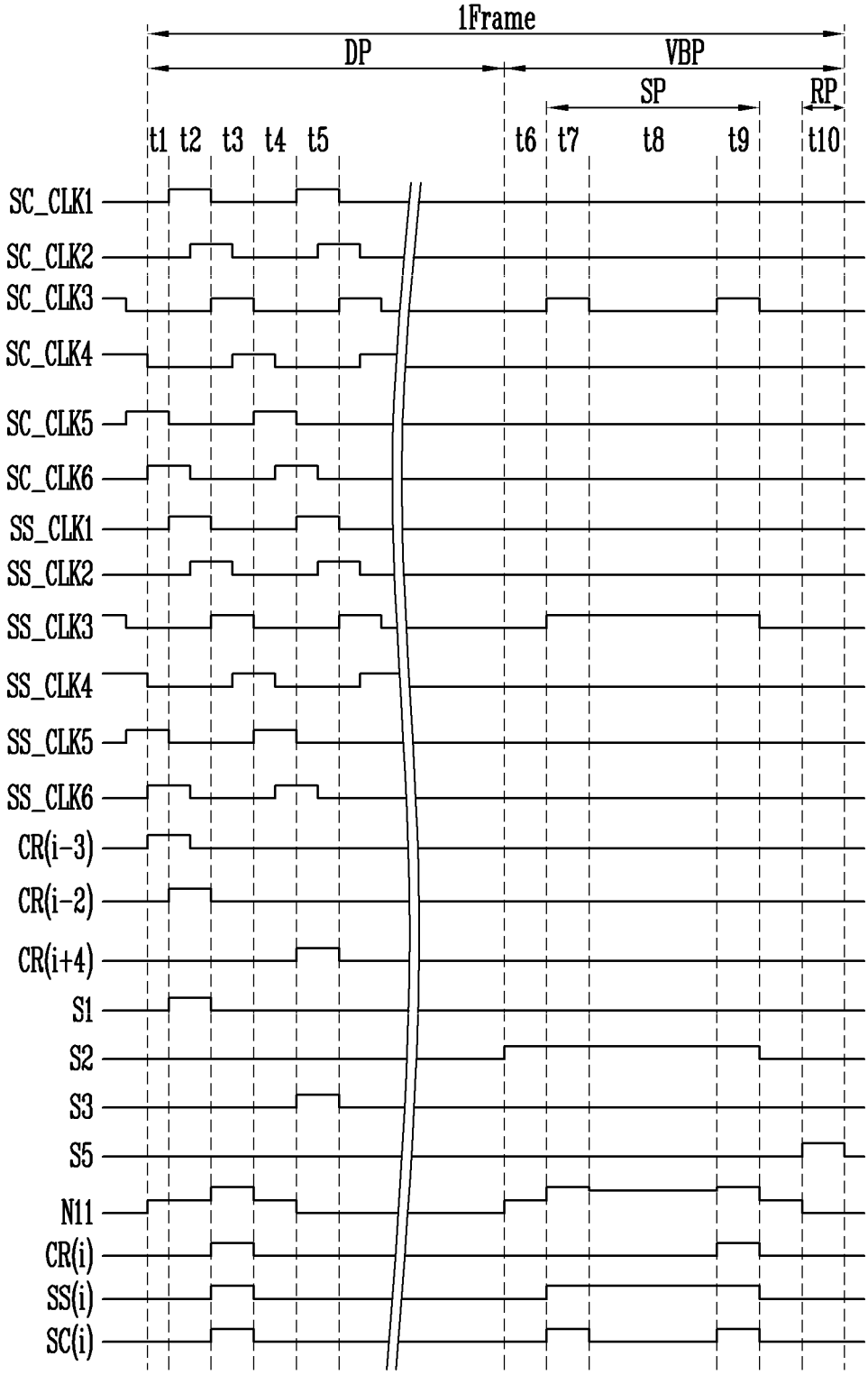
FIG. 8 is a waveform diagram illustrating an embodiment of a method of driving the stage shown in FIG. 7.
Figure 9:
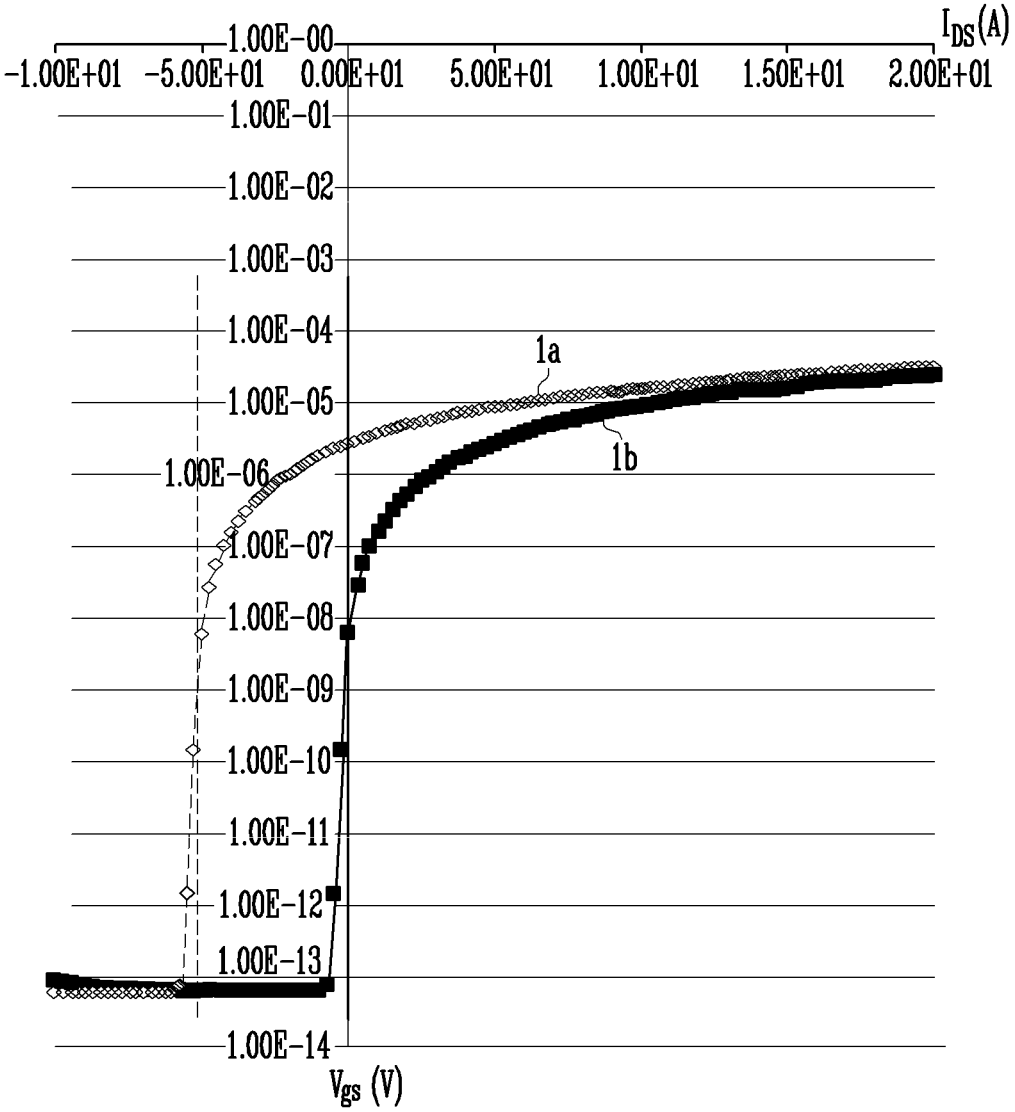
FIG. 9 is a diagram for describing a leakage current reduction method of the stage shown in FIG. 7.

FIG. 8 is a waveform diagram illustrating an embodiment of a method of driving the stage shown in FIG. 7. FIG. 9 is a diagram for describing a leakage current reduction method of the stage shown in FIG. 7.

FIG. 8 shows an example in which sensing is performed on an i-th pixel column during a sensing period. Here, the i-th pixel column is connected to the i-th stage STi' receiving the third scan clock signal SC_CLK3 and the third sensing clock signal SS_CLK3. Here, the i-th stage STi' may be configured to receive the third control signal S3 and not to receive the fourth control signal S4.

In addition, referring to FIG. 8, one frame period 1Frame may include a display period DP and a vertical blank period VBP, and the vertical blank period VBP may include a sensing period SP and a reset period RP.

Referring to FIGS. 7 and 8, as the (i−3)-th carry signal CR(i−3) is supplied in synchronization with the sixth scan clock signal SC_CLK6 in a first period t1, the (3-1)-th transistor T3-1 and the (3-2)-th transistor T3-2 may be turned on. Then, the high voltage of the (i−3)-th carry signal CR(i−3) may be supplied to the eleventh node N11, and the eleventh node N11 may be set to the high voltage.

When the eleventh node N11 is set to the high voltage, the tenth transistor T10, the twelfth transistor T12, and the thirteenth transistor T13 are turned on. However, since the third scan clock signal SC_CLK3 and the third sensing clock signal SS_CLK3 are not supplied during the first period t1, the carry signal CR(i), the scan signal SC(i), and the sensing signal SS(i) are not output.

In addition, as the (i−3)-th carry signal CR(i−3) is supplied in the first period t1, the eighth transistor T8 may be turned on. Then, the low voltage of the second power VSS2 may be supplied to the twelfth node N12, and thus the twelfth node N12 may be set to the low voltage.

The (i−2)-th carry signal CR(i−2) and the first control signal S1 are supplied to the input unit 211' in synchronization with the first scan clock signal SC_CLK1 in a second period t2. As the first control signal S1 is supplied, the twenty-first transistor T21 and the twenty-third transistor T23 of the i-th stage STi' are turned on. When the twenty-first transistor T21 and the twenty-third transistor T23 are turned on, the high voltage of the (i−2)-th carry signal CR(i−2) is supplied to the fourth node N4. When the high voltage is supplied to the fourth node N4, the twenty-second transistor T22, the twenty-fourth transistor T24, and the twenty-fifth transistor T25 are turned on.

When the twenty-second transistor T22 is turned on, the high voltage of the third power VDD may be supplied to the third node N3, and thus the high voltage of the third node N3 may be stably maintained.

When the twenty-fourth transistor T24 is turned on, the high voltage of the third power VDD is supplied to the first node N1, and thus the first node N1 is set to the high voltage. At this time, the third capacitor C3 stores the high voltage of the fourth node N4.

When the twenty-fifth transistor T25 is turned on, the low voltage of the second power VSS2 is supplied to the second node N2, and thus the second node N2 is set to the low voltage.

The first control signal S1 may be selectively supplied to a stage connected to a pixel column to be sensed in a subsequent sensing period SP to set the voltages of the first node N1 and the second node N2 to the high voltage and the low voltage, respectively.

Meanwhile, since the second control signal S2 is not supplied during the second period t2, the twenty-sixth transistor T26 and the twenty-seventh transistor T27 maintain a turn-off state, and voltage control of the first node N1 and the second node N2 does not affect the voltages of the eleventh node N11 and the twelfth node N12. Therefore, during the second period t2, the eleventh node N11 and the twelfth node N12 may maintain voltages of a previous period (for example, the eleventh node N11 may maintain the high voltage and the twelfth node N12 may maintain the low voltage).

The third scan clock signal SC_CLK3 and the third sensing clock signal SS_CLK3 are supplied to the stage STi' in a third period t3. At this time, as the eleventh node N11 is maintained at the high voltage, since the tenth transistor T10, the twelfth transistor T12, and the thirteenth transistor T13 maintain a turn-on state, the carry signal CR(i), the scan signal SC(i), and the sensing signal SS(i) are output.

During the third period t3, the voltage of the eleventh node N11 may be set to a voltage higher than that in the first period t1 by coupling of the first capacitor C1 and the second capacitor C2.

When the supply of the third scan clock signal SC_CLK3 and the third sensing clock signal SS_CLK3 is stopped in the fourth period t4, the output of the carry signal CR(i), the scan signal SC(i), and the sensing signal SS(i) is stopped, and the voltage of the eleventh node N11 may be returned to the voltage in the first period t1.

As the (i+4)-th carry signal CR(i+4) is supplied in synchronization with the first scan clock signal SC_CLK1 in a fifth period t5, the (2-1)-th transistor T2-1 and the (2-2)-th transistor T2-2 may be turned on. Then, the low voltage of the second power VSS2 may be supplied to the eleventh node N11, and the eleventh node N11 may be set to the low voltage.

Meanwhile, as the third control signal S3 is supplied in the fifth period t5, the fifth transistor T5 may be diode-connected to set the fifth node N5 to the high voltage. Then, the seventh transistor T7 may be turned on, the third control signal S3 may be supplied to the twelfth node N12, and the twelfth node N12 may be set to the high voltage. Then, the low voltage of the first power VSS1 and the second power VSS2 may be output as the scan signal SC(i), the sensing signal SS(i), and the carry signal CR(i) through the eleventh transistor T11, the fourteenth transistor T14, and the sixteenth transistor T16.

During the fifth period t5, the third scan clock signal SC_CLK3 applied to one electrode of the tenth transistor T10, that is, a source electrode, maintains the low level. In an embodiment, the low level of the third scan clock signal SC_CLK3 may be set to be lower than the gate off voltage, and may be, for example, about −7 V. Therefore, a source voltage of the tenth transistor T10 may be set to about −7 V.

In addition, in an embodiment, the voltage of the second power VSS2 may be set to be lower than the low level of the scan clock signal SC_CLK, and may be, for example, about −9 V. In such an embodiment, the voltage of the eleventh node N11 may be set to about −9 V. Accordingly, a gate voltage of the tenth transistor T10 may be set to about −9 V lower than the source voltage (−7 V).

In addition, when the twelfth node N12 is set to a high node, the voltage of the first power VSS1 may be applied to the other electrode, that is, a drain electrode of the tenth transistor T10, through the eleventh transistor T11 that is turned on. In an embodiment, the first power VSS1 may be set to the gate off voltage, and may be, for example, about −5 V.

As described above, when the voltage of the second power VSS2 is set to be lower than the low level of the scan clock signal SC_CLK, the gate voltage of the tenth transistor T10 may be set to be lower than the source voltage. In an embodiment, a gate-source voltage Vgs of the tenth transistor T10 may be about −2 V. Referring to FIG. 9, when the gate-source voltage Vgs of the tenth transistor T10 is set to be lower than 0 V (that is, when a transistor characteristic is switched to a negative), a drain-source current IDS is reduced (curve 1*b*) in comparison with a case in which the gate-source voltage Vgs is set to be higher than 0 V (curve 1*a*). In the disclosure, since the gate-source voltage Vgs of a negative value is applied to the tenth transistor T10, a leakage current flowing through the transistor T10 may be reduced according to a Vgs-IDS curve change (change from the curve 1*a* to the curve 1*b*).

Generally, a drain current is reduced when Vgs is reduced from a voltage lower than 0 V to a certain range, but when the Vgs is reduced to a certain range or more, the drain current may rapidly increase. Therefore, the voltage of the second power VSS2 and the low level of the scan clock signal SC_CLK may be set appropriately so that the leakage current of the tenth transistor T10 may be reduced by control of Vgs. In an embodiment, the voltage of the second power VSS2 and the low level of the scan clock signal SC_CLK may be set to have a difference of 0 V to −2 V.

The second control signal S2 is supplied to the stage STi' in a sixth period t6. As the second control signal S2 is supplied, the twenty-sixth transistor T26 and the twenty-seventh transistor T27 are turned on.

When the twenty-sixth transistor T26 is turned on, the high voltage of the first node N1 is supplied to the eleventh node N11. When the eleventh node N11 is set to the high voltage, the tenth transistor T10, the twelfth transistor T12, and the thirteenth transistor T13 are turned on. Since the third scan clock signal SC_CLK3 and the third sensing clock signal SS_CLK3 are not supplied in the sixth period t6, the carry signal CR(i), the scan signal SC(i), and the sensing signal SS(i)) are not output.

When the twenty-seventh transistor T27 is turned on, the low voltage of the second node N2 may be supplied to the twelfth node N12, and thus the twelfth node N12 may be set to the low voltage.

The first node N1 is set to the high voltage only in the stage receiving the first control signal S1 in the second period t2. Therefore, the eleventh node N11 may be set to the high voltage and the twelfth node N12 may be set to the low voltage in the sixth period t6.

The second control signal S2, the third scan clock signal SC_CLK3, and the third sensing clock signal SS_CLK3 are supplied to the stage STi' in a seventh period t7. At this time, since the eleventh node N11 is set to the high voltage, the tenth transistor T10 and the thirteenth transistor T13 are maintained in the turn-on state, and the scan signal SC(i) and the sensing signal SS(i) are output. The characteristic (for example, the threshold voltage, the mobility, and the like) of the driving transistor provided in the pixel PX receiving the scan signal SC(i) and the sensing signal SS(i) may be measured.

At this time, the twelfth transistor T12 may also maintain the turn-on state, and thus the third scan clock signal SC_CLK3 may be output as the carry signal CR(i). The carry signal CR(i) output from the stage STi' during the sensing period SP may be applied to the first to third carry input terminals CRIN1 to CRIN3 of the next stage or the previous stage. Then, the voltage of the eleventh node N11 of the next stage or the previous stage may be set to the high voltage. However, since the scan clock signal SC_CLK and the sensing clock signal SS_CLK are not supplied to the next stage or the previous stage, unacceptable scan signal and sensing signal are not output from the next stage and the previous stage. Therefore, the carry signal and the scan signal may be controlled by the same scan clock signal SC_CLK. As a result, the scan driver 210 does not have a separate clock signal for controlling the carry signal output, and thus a wire for the clock signal may be reduced.

The voltage of the eleventh node N11 during the seventh period t7 may be set to a voltage higher than that in the sixth period t6 by the coupling of the first capacitor C1 and the second capacitor C2.

The supply of the sensing clock signal SS_CLK3 to the stage STi' is stopped in the eighth period t8. Then, the output of the sensing signal SS(i) is stopped and the voltage of the eleventh node N11 may be set to a voltage that is somewhat lower than that in the seventh period t7 as the coupling of the first capacitor C1 is released.

A characteristic of an organic light emitting diode provided in the pixel PX may be measured during an eighth period t8.

The scan clock signal SC_CLK3 and the sensing clock signal SS_CLK3 are supplied to the stage STi' in a ninth period t9, and thus the scan signal SC(i) and the sensing signal SS(i) are output. In addition, the carry signal CR(i) may be output during the ninth period t9.

In an embodiment, the data signal of a corresponding frame may be supplied to the pixel PX during the ninth period t9, and thus the driving transistor may be initialized.

The fifth control signal S5 is supplied to the stage STi' during a tenth period t10. Therefore, the (1-1)-th transistor T1-1 and the (1-2)-th transistor T1-2 are turned on, and the voltage of the eleventh node N11 is initialized as the low voltage of the second power VSS2.

Figure 10:
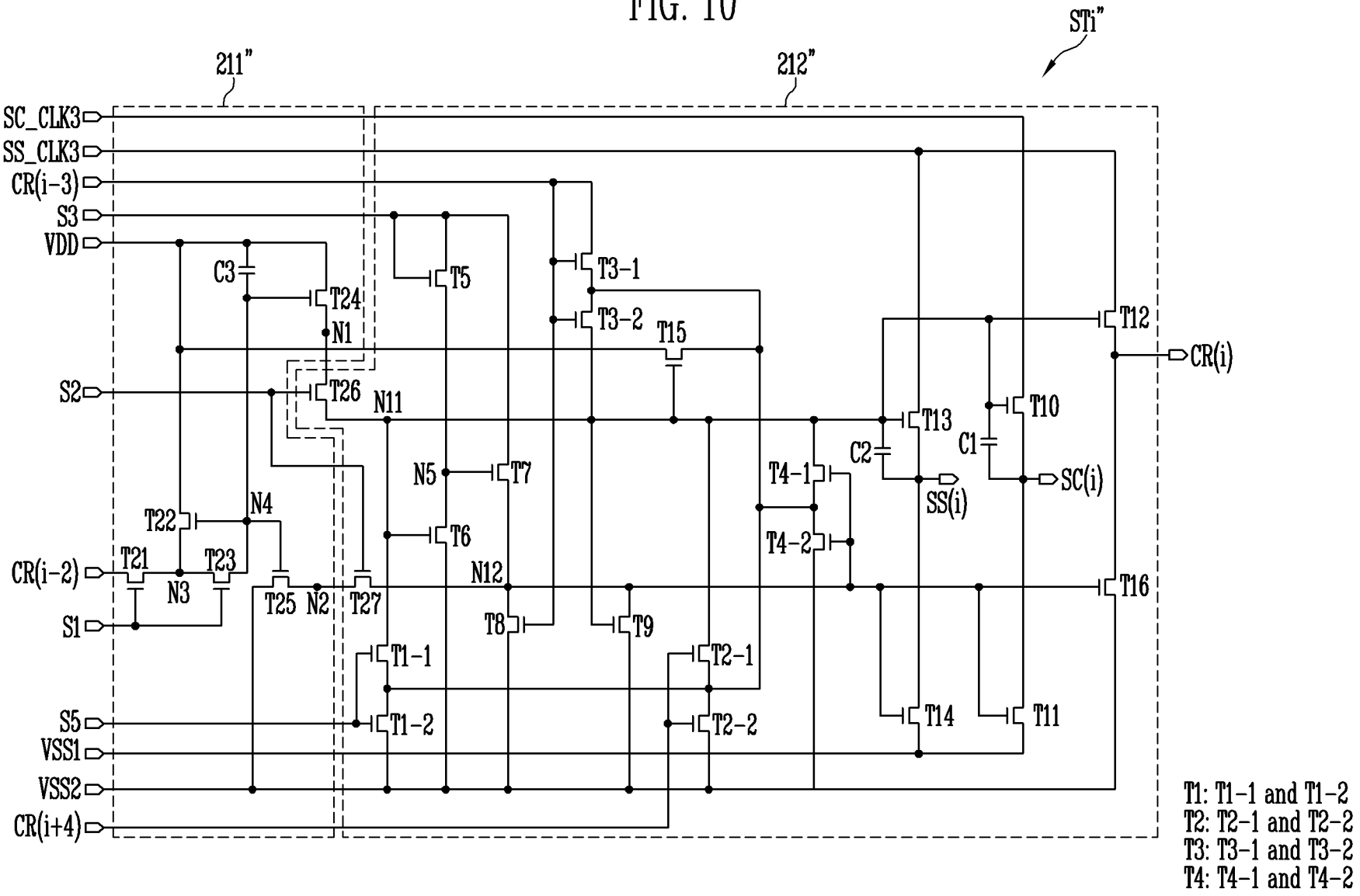
FIG. 10 is a circuit diagram illustrating still another embodiment of the stage shown in FIG. 3.

FIG. 10 is a circuit diagram illustrating still another embodiment of the stage shown in FIG. 3. In FIG. 10, for convenience of description, only one stage STi" is exemplarily shown. In addition, hereinafter, for convenience of description, it is assumed that a fact that a certain signal is supplied means that a high voltage is supplied and a fact that a certain signal is not supplied means that a low voltage is supplied.

In addition, in FIG. 10, a stage STi" receiving a third scan clock signal SC_CLK3 and a third sensing clock signal SS_CLK3 is representatively shown. In describing FIG. 10, the third scan clock signal SC_CLK3 is referred to as the scan clock signal, and the third sensing clock signal SS_CLK3 is referred to as the sensing clock signal.

Referring to FIGS. 3 and 10, the stage STi" according to still another embodiment of the disclosure may include an input unit 211" and an output buffer 212". The input unit 211" may include twenty-first to twenty-seventh transistors T21 to T27 and a third capacitor C3. In addition, the output buffer 212" includes first to sixteenth transistors T1 to T16 and first and second capacitors C1 and C2.

A configuration of the input unit 211" will be described first as follows.

A first electrode of the third capacitor C3 is connected to a third power terminal V3 to which the third power VDD is input and a second electrode is connected to a gate electrode of the twenty-fourth transistor T24 (that is, a fourth node N4). The third capacitor C3 stores a voltage corresponding to the gate electrode of the twenty-fourth transistor T24. Here, for example, the third power VDD may be set to the gate on voltage.

The twenty-first transistor T21 is connected between a second carry input terminal CRIN2 to which an (i−2)-th carry signal CR(i−2) is input and a third node N3. A gate electrode of the twenty-first transistor T21 is connected to a first input terminal IN1 to which a first control signal S1 is input. The twenty-first transistor T21 may be turned on when the first control signal S1 is supplied to supply a voltage corresponding to the (i−2)-th carry signal CR(i−2) to the third node N3.

The twenty-second transistor T22 is connected between the third node N3 and the third power terminal V3 to which the third power VDD is input. A gate electrode of the twenty-second transistor T22 is connected to the fourth node N4. The twenty-second transistor T22 is turned on or off in response to a voltage of the fourth node N4.

The twenty-third transistor T23 is connected between the third node N3 and the fourth node N4. A gate electrode of the twenty-third transistor T23 is connected to the first input terminal IN1 to which the first control signal S1 is input. The twenty-third transistor T23 is turned on when the first control signal S1 is supplied to supply a voltage of the third node N3 to the fourth node N4.

The twenty-fourth transistor T24 is connected between the third power terminal V3 to which the third power VDD is input and the first node N1. A gate electrode of the twenty-fourth transistor T24 is connected to the fourth node N4. The twenty-fourth transistor T24 is turned on or off in response to the voltage of the fourth node N4. When the twenty-fourth transistor T24 is turned on, the high voltage of the third power VDD is supplied to the first node N1.

The twenty-fifth transistor T25 is connected between the second power terminal V2 to which the second power VSS2 is input and the second node N2. A gate electrode of the twenty-fifth transistor T25 is connected to the fourth node N4. The twenty-fifth transistor T25 is turned on or off in response to the voltage of the fourth node N4. When the twenty-fifth transistor T25 is turned on, the low voltage of the second power VSS2 is supplied to the second node N2. Here, the second power VSS2 may be a voltage that is set to be lower than the third power VDD, and may be set to be lower than the gate off voltage. In an embodiment, the second power VSS2 may be set to be lower than the first power VSS1 and the low level of the scan clock signal SC_CLK3, and may be about −9 V.

The output buffer 212" is connected to the input unit 211" through the first node N1 and the second node N2.

The first transistor T1 may include a (1-1)-th transistor T1-1 and a (1-2)-th transistor T1-2. The (1-1)-th transistor T1-1 and the (1-2)-th transistor T1-2 are connected in series between an eleventh node N11 and the second power terminal V2 to which the second power VSS2 is input. Gate electrodes of the (1-1)-th transistor T1-1 and the (1-2)-th transistor T1-2 are connected to a fifth input terminal IN5 to which a fifth control signal S5 is input. The (1-1)-th transistor T1-1 and the (1-2)-th transistor T1-2 may be turned on when the fifth control signal S5 is supplied to set a voltage of the eleventh node N11 to the voltage of the second power VSS2.

The second transistor T2 may include a (2-1)-th transistor T2-1 and a (2-2)-th transistor T2-2. The (2-1)-th transistor T2-1 and the (2-2)-th transistor T2-2 are connected in series between the eleventh node N11 and the second power terminal V2 to which the second power VSS2 is input. Gate electrodes of the (2-1)-th transistor T2-1 and the (2-2)-th transistor T2-2 are connected to the third carry input terminal CRIN3 to which the (i+4)-th carry signal CR(i+4) or the (i+3)-th carry signal CR(i+3) is input. The (2-1)-th transistor T2-1 and the (2-2)-th transistor T2-2 may be turned on when the (i+4)-th carry signal CR(i+4) or the (i+3)-th carry signal CR(i+3) is supplied to set the voltage of the eleventh node N11 to the voltage of the second power VSS2.

The third transistor T3 may include a (3-1)-th transistor T3-1 and a (3-2)-th transistor T3-2. The (3-1)-th transistor T3-1 and the (3-2)-th transistor T3-2 are connected in series between the eleventh node N11 and the first carry input terminal CRIN1 to which an (i−3)-th carry signal CR(i−3) is input. Gate electrodes of the (3-1)-th transistor T3-1 and the (3-2)-th transistor T3-2 are connected to the first carry input terminal CRIN1. The (3-1)-th transistor T3-1 and the (3-2)-th transistor T3-2 may be turned on when the (i−3)-th carry signal CR(i−3) is supplied to supply the (i−3)-th carry signal CR(i−3) to the eleventh node N11.

The fourth transistor T4 may include a (4-1)-th transistor T4-1 and a (4-2)-th transistor T4-2. The (4-1)-th transistor T4-1 and the (4-2)-th transistor T4-2 are connected in series between the eleventh node N11 and the second power terminal V2 to which the second power VSS2 is input. Gate electrodes of the (4-1)-th transistor T4-1 and the (4-2)-th transistor T4-2 are connected to a twelfth node N12. The (4-1)-th transistor T4-1 and the (4-2)-th transistor T4-2 are turned on or off in response to power of the twelfth node N12. When the (4-1)-th transistor T4-1 and the (4-2)-th transistor T4-2 are turned on, the voltage of the second power VSS2 may be supplied to the eleventh node N11.

The fifth transistor T5 is diode-connected between the third input terminal IN3 receiving the third control signal S3 and a gate electrode of the seventh transistor T7 (that is, a fifth node N5). The fifth transistor T5 may be connected in a diode form when the third control signal S3 is supplied to supply the third control signal S3 to the fifth node N5.

The sixth transistor T6 is connected between the fifth node N5 and the second power terminal V2 to which the second power VSS2 is input. A gate electrode of the sixth transistor T6 is connected to the eleventh node N11. The sixth transistor T6 may be turned on when the eleventh node N11 is set to the high voltage to supply the voltage of the second power VSS2 to the fifth node N5.

The seventh transistor T7 is connected between the third input terminal IN3 to which the third control signal S3 is input and the twelfth node N12. The gate electrode of the seventh transistor T7 is connected to the fifth node N5. The seventh transistor T7 is turned on or off in response to a voltage of the fifth node N5. As the seventh transistor T7 is turned on, a voltage of the third control signal S3 may be supplied to the twelfth node N12.

The eighth transistor T8 is connected between the twelfth node N12 and the second power terminal V2 to which the second power VSS2 is input. A gate electrode of the eighth transistor T8 is connected to the first carry input terminal CRIN1 to which the (i−3)-th carry signal CR(i−3) is input. The eighth transistor T8 may be turned on when the (i−3)-th carry signal CR(i−3) is supplied to set the voltage of the twelfth node N12 to the low voltage of the second power VSS2.

The ninth transistor T9 is connected between the twelfth node N12 and the second power terminal V2 to which the second power VSS2 is input. A gate electrode of the ninth transistor T9 is connected to the eleventh node N11. The ninth transistor T9 may be turned on when the high voltage is supplied to the eleventh node N11 to set the voltage of the twelfth node N12 to the low voltage of the second power VSS2.

The tenth transistor T10, the eleventh transistor T11, and the first capacitor C1 operate as a buffer circuit for outputting the scan signal SC(i).

The tenth transistor T10 is connected between the scan clock terminal SCCK to which the scan clock signal SC_CLK3 is input and a first output terminal OUT1 outputting the scan signal SC(i). A gate electrode of the tenth transistor T10 is connected to the eleventh node N11. The tenth transistor T10 may be turned on when the eleventh node N11 is set to the high voltage to output the scan clock signal SC_CLK3 as the scan signal SC(i).

Here, the scan clock signal SC_CLK3 may have a logic high level and a logic low level. Here, the logic high level corresponds to the gate on voltage, and the logic low level is set to be lower than the gate off voltage. For example, the logic high level may be about 25 V. For example, when the gate off voltage is about −5 V, the logic low level may be about −7 V.

The eleventh transistor T11 is connected between the first output terminal OUT1 and the first power terminal V1 receiving the first power VSS1. A gate electrode of the eleventh transistor T11 is connected to the twelfth node N12. The eleventh transistor T11 may be turned on or off in response to the voltage of the twelfth node N12. As the eleventh transistor T11 is turned on, the low voltage of the first power VSS1 may be output as the scan signal SC(i). Here, the first power VSS1 may be a voltage that is set to be lower than the third power VDD, and for example, the first power VSS1 may be set to the gate off voltage. In an embodiment, the first power VSS1 may be set to the gate off voltage and may be about −5 V.

The first capacitor C1 is connected between the first output terminal OUT1 and the eleventh node N11.

The twelfth transistor T12 and the sixteenth transistor T16 operate as a buffer circuit for outputting the carry signal CR(i).

The twelfth transistor T12 is connected between the sensing clock terminal SSCK to which the sensing clock signal SS_CLK3 is input and the carry output terminal CR outputting the carry signal CR(i). A gate electrode of the twelfth transistor T12 is connected to the eleventh node N11. The twelfth transistor T12 may be turned on when the eleventh node N11 is set to the high voltage to output the sensing clock signal SS_CLK3 as the carry signal CR(i).

The sixteenth transistor T16 is connected between the carry output terminal CR and the second power terminal V2 receiving the second power VSS2. A gate electrode of the sixteenth transistor T16 is connected to the twelfth node N12. The sixteenth transistor T16 may be turned on or off in response to the voltage of the twelfth node N12. As the sixteenth transistor T16 is turned on, the low voltage of the second power VSS2 may be output as the carry signal CR(i).

The thirteenth transistor T13, the fourteenth transistor T14, and the second capacitor C2 operate as a buffer circuit for outputting the sensing signal SS(i).

The thirteenth transistor T13 is connected between the sensing clock terminal SSCK receiving the sensing clock signal SS_CLK and a second output terminal OUT2 outputting the sensing signal SS(i). A gate electrode of the thirteenth transistor T13 is connected to the eleventh node N11. The thirteenth transistor T13 may be turned on when the eleventh node N11 is set to the high voltage to output the sensing clock signal SS_CLK as the sensing signal SS(i).

The fourteenth transistor T14 is connected between the second output terminal OUT2 and the first power terminal V1 receiving the first power VSS1. A gate electrode of the fourteenth transistor T14 is connected to the twelfth node N12. The fourteenth transistor T14 may be turned on or off in response to the voltage of the twelfth node N12. As the fourteenth transistor T14 is turned on, the low voltage of the first power VSS1 may be output as the sensing signal SS(i).

The second capacitor C2 is connected between the second output terminal OUT2 and the eleventh node N11.

One end of the fifteenth transistor T15 is connected to a common electrode of the (1-1)-th transistor T1-1 and the (1-2)-th transistor T1-2, a common electrode of the (2-1)-th transistor T2-1 and the (2-2)-th transistor T2-2, a common electrode of the (3-1)-th transistor T3-1 and the (3-2)-th transistor T3-2, and a common electrode of the (4-1)-th transistor T4-1 and the (4-2)-th transistor T4-2. The other end of the fifteenth transistor T15 is connected to the third power terminal V3 to which the third power VDD is input. A gate electrode of the fifteenth transistor T15 is connected to the eleventh node N11. The fifteenth transistor T15 is turned on or off in response to the voltage of the eleventh node N11.

The stage STi" shown in FIG. 10 is different from the stage STi' shown in FIG. 7 in that the buffer circuit for outputting the carry signal CR(i) shares the sensing clock signal SS_CLK3 with the buffer circuit for outputting the sensing signal SS(i), instead of the scan clock signal SC_CLK.

Figure 11:
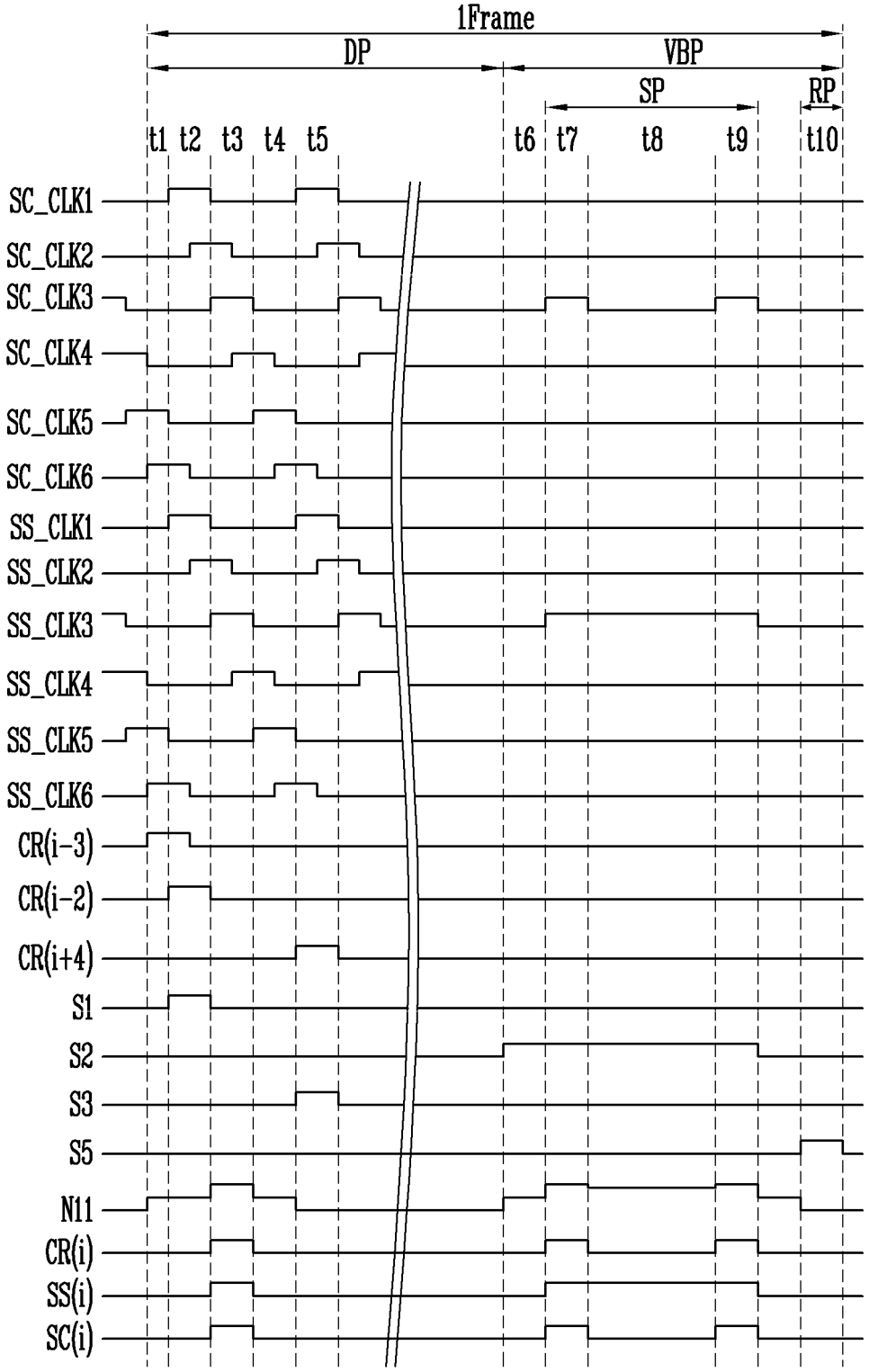
FIG. 11 is a waveform diagram illustrating an embodiment of a method of driving the stage shown in FIG. 10.

FIG. 11 is a waveform diagram illustrating an embodiment of a method of driving the stage shown in FIG. 10.

FIG. 11 shows an example in which sensing is performed on an i-th pixel column during a sensing period. Here, the i-th pixel column is connected to the i-th stage STI" receiving the third scan clock signal SC_CLK3 and the third sensing clock signal SS_CLK3. Here, the i-th stage STI" may be configured to receive the third control signal S3 and not to receive the fourth control signal S4.

In addition, referring to FIG. 11, one frame period 1Frame may include a display period DP and a vertical blank period VBP, and the vertical blank period VBP may include a sensing period SP and a reset period RP.

Referring to FIGS. 10 and 11, as the (i−3)-th carry signal CR(i−3) is supplied in synchronization with the sixth sensing clock signal SS_CLK6 in a first period t1, the (3-1)-th transistor T3-1 and the (3-2)-th transistor T3-2 may be turned on. Then, the high voltage of the (i−3)-th carry signal CR(i−3) may be supplied to the eleventh node N11, and the eleventh node N11 may be set to the high voltage.

When the eleventh node N11 is set to the high voltage, the tenth transistor T10, the twelfth transistor T12, and the thirteenth transistor T13 are turned on. However, since the third scan clock signal SC_CLK3 and the third sensing clock signal SS_CLK3 are not supplied during the first period t1, the carry signal CR(i), the scan signal SC(i), and the sensing signal SS(i) are not output.

In addition, as the (i−3)-th carry signal CR(i−3) is supplied in the first period t1, the eighth transistor T8 may be turned on. Then, the low voltage of the second power VSS2 may be supplied to the twelfth node N12, and thus the twelfth node N12 may be set to the low voltage.

The (i−2)-th carry signal CR(i−2) and the first control signal S1 are supplied to the input unit 211" in synchronization with the first sensing clock signal SS_CLK1 in a second period t2. As the first control signal S1 is supplied, the twenty-first transistor T21 and the twenty-third transistor T23 of the i-th stage STI" are turned on. When the twenty-first transistor T21 and the twenty-third transistor T23 are turned on, the high voltage of the (i−2)-th carry signal CR(i−2) is supplied to the fourth node N4. When the high voltage is supplied to the fourth node N4, the twenty-second transistor T22, the twenty-fourth transistor T24, and the twenty-fifth transistor T25 are turned on.

When the twenty-second transistor T22 is turned on, the high voltage of the third power VDD may be supplied to the third node N3, and thus the high voltage of the third node N3 may be stably maintained.

When the twenty-fourth transistor T24 is turned on, the high voltage of the third power VDD is supplied to the first node N1, and thus the first node N1 is set to the high voltage. At this time, the third capacitor C3 stores the high voltage of the fourth node N4.

When the twenty-fifth transistor T25 is turned on, the low voltage of the second power VSS2 is supplied to the second node N2, and thus the second node N2 is set to the low voltage.

The first control signal S1 may be selectively supplied to a stage connected to a pixel column to be sensed in a subsequent sensing period SP to set the voltages of the first node N1 and the second node N2 to the high voltage and the low voltage, respectively.

Meanwhile, since the second control signal S2 is not supplied during the second period t2, the twenty-sixth transistor T26 and the twenty-seventh transistor T27 maintain a turn-off state, and voltage control of the first node N1 and the second node N2 does not affect the voltages of the eleventh node N11 and the twelfth node N12. Therefore, during the second period t2, the eleventh node N11 and the twelfth node N12 may maintain voltages of a previous period (for example, the eleventh node N11 may maintain the high voltage and the twelfth node N12 may maintain the low voltage).

The third scan clock signal SC_CLK3 and the third sensing clock signal SS_CLK3 are supplied to the stage STI" in a third period t3. At this time, as the eleventh node N11 is maintained at the high voltage, since the tenth transistor T10, the twelfth transistor T12, and the thirteenth transistor T13 maintain a turn-on state, the carry signal CR(i), the scan signal SC(i), and the sensing signal SS(i) are output.

During the third period t3, the voltage of the eleventh node N11 may be set to a voltage higher than that in the first period t1 by coupling of the first capacitor C1 and the second capacitor C2.

When the supply of the third scan clock signal SC_CLK3 and the third sensing clock signal SS_CLK3 is stopped in the fourth period t4, the output of the carry signal CR(i), the scan signal SC(i), and the sensing signal SS(i) is stopped, and the voltage of the eleventh node N11 may be returned to the voltage in the first period t1.

As the (i+4)-th carry signal CR(i+4) is supplied in synchronization with the first sensing clock signal SS_CLK1 in a fifth period t5, the (2-1)-th transistor T2-1 and the (2-2)-th transistor T2-2 may be turned on. Then, the low voltage of the second power VSS2 may be supplied to the eleventh node N11, and the eleventh node N11 may be set to the low voltage.

Meanwhile, as the third control signal S3 is supplied in the fifth period t5, the fifth transistor T5 may be diode-connected to set the fifth node N5 to the high voltage. Then, the seventh transistor T7 may be turned on, the third control signal S3 may be supplied to the twelfth node N12, and the twelfth node N12 may be set to the high voltage. Then, the low voltage of the first power VSS1 and the second power VSS2 may be output as the scan signal SC(i), the sensing signal SS(i), and the carry signal CR(i) through the eleventh transistor T11, the fourteenth transistor T14, and the sixteenth transistor T16.

During the fifth period t5, the third scan clock signal SC_CLK3 applied to one electrode of the tenth transistor T10, that is, a source electrode, maintains the low level. In an embodiment, the low level of the third scan clock signal SC_CLK3 may be set to be lower than the gate off voltage, and may be, for example, about −7 V. Therefore, a source voltage of the tenth transistor T10 may be set to about −7 V.

In addition, in an embodiment, the voltage of the second power VSS2 may be set to be lower than the low level of the scan clock signal SC_CLK, and may be, for example, about −9 V. In such an embodiment, the voltage of the eleventh node N11 may be set to about −9 V. Accordingly, a gate voltage of the tenth transistor T10 may be set to about −9 V lower than the source voltage (−7 V).

In addition, when the twelfth node N12 is set to a high node, the voltage of the first power VSS1 may be applied to the other electrode, that is, a drain electrode of the tenth transistor T10, through the eleventh transistor T11 that is turned on. In an embodiment, the first power VSS1 may be set to the gate off voltage, and may be, for example, about −5 V.

The second control signal S2 is supplied to the stage STI" in a sixth period t6. As the second control signal S2 is supplied, the twenty-sixth transistor T26 and the twenty-seventh transistor T27 are turned on.

When the twenty-sixth transistor T26 is turned on, the high voltage of the first node N1 is supplied to the eleventh node N11. When the eleventh node N11 is set to the high voltage, the tenth transistor T10, the twelfth transistor T12, and the thirteenth transistor T13 are turned on. Since the third scan clock signal SC_CLK3 and the third sensing clock signal SS_CLK3 are not supplied in the sixth period t6, the carry signal CR(i), the scan signal SC(i), and the sensing signal SS(i)) are not output.

When the twenty-seventh transistor T27 is turned on, the low voltage of the second node N2 may be supplied to the twelfth node N12, and thus the twelfth node N12 may be set to the low voltage.

The first node N1 is set to the high voltage only in the stage receiving the first control signal S1 in the second period t2. Therefore, the eleventh node N11 may be set to the high voltage and the twelfth node N12 may be set to the low voltage in the sixth period t6.

The second control signal S2, the third scan clock signal SC_CLK3, and the third sensing clock signal SS_CLK3 are supplied to the stage STI" in a seventh period t7. At this time, since the eleventh node N11 is set to the high voltage, the tenth transistor T10 and the thirteenth transistor T13 are maintained in the turn-on state, and the scan signal SC(i) and the sensing signal SS(i) are output. The characteristic (for example, the threshold voltage, the mobility, and the like) of the driving transistor provided in the pixel PX receiving the scan signal SC(i) and the sensing signal SS(i) may be measured.

At this time, the twelfth transistor T12 may also maintain the turn-on state, and thus the third sensing clock signal SS_CLK3 may be output as the carry signal CR(i). The carry signal CR(i) output from the stage STI" during the sensing period SP may be applied to the first to third carry input terminals CRIN1 to CRIN3 of the next stage or the previous stage. Then, the voltage of the eleventh node N11 of the next stage or the previous stage may be set to the high voltage. However, since the scan clock signal SC_CLK and the sensing clock signal SS_CLK are not supplied to the next stage or the previous stage, unacceptable scan signal and sensing signal are not output from the next stage and the previous stage. Therefore, the carry signal and the sensing signal may be controlled by the same sensing clock signal SC_CLK. As a result, the scan driver 210 does not have a separate clock signal for controlling the carry signal output, and thus a wire for the clock signal may be reduced.

The voltage of the eleventh node N11 during the seventh period t7 may be set to a voltage higher than that in the sixth period t6 by the coupling of the first capacitor C1 and the second capacitor C2.

The supply of the sensing clock signal SS_CLK3 to the stage STI" is stopped in the eighth period t8. Then, the output of the sensing signal SS(i) and the carry signal CR(i) is stopped and the voltage of the eleventh node N11 may be set to a voltage that is somewhat lower than that in the seventh period t7 as the coupling of the first capacitor C1 is released.

A characteristic of an organic light emitting diode provided in the pixel PX may be measured during an eighth period t8.

The scan clock signal SC_CLK3 and the sensing clock signal SS_CLK3 are supplied to the stage STI" in a ninth period t9, and thus the scan signal SC(i) and the sensing signal SS(i) are output. In addition, the carry signal CR(i) may be output during the ninth period t9.

In an embodiment, the data signal of a corresponding frame may be supplied to the pixel PX during the ninth period t9, and thus the driving transistor may be initialized.

The fifth control signal S5 is supplied to the stage STI" during a tenth period t10. Therefore, the (1-1)-th transistor T1-1 and the (1-2)-th transistor T1-2 are turned on, and the voltage of the eleventh node N11 is initialized as the low voltage of the second power VSS2.

It will be understood by those skilled in the art that the disclosure may be carried out in other specific forms without changing the technical spirit or essential characteristics thereof. Therefore, it should be understood that the above-described embodiments are illustrative and not restrictive in all aspects. The scope of the disclosure is defined by the following claims rather than the above detailed description, and it is intended that all changes and modifications drawn from the meaning and range of the claims and the equivalents thereof are included within the scope of the disclosure.

What is claimed is:

1. A stage connected to each of scan lines and to supply a scan signal and a sensing signal to the scan lines, the stage comprising:

an input unit configured to control voltages of a first node and a second node based on a first control signal and a previous stage carry signal; and an output buffer including an eleventh node and a twelfth node electrically connected to the first node and the second node, respectively, in response to a second control signal, and configured to output a carry signal and the scan signal in response to a scan clock signal according to voltages of the eleventh node and the twelfth node and to output the sensing signal in response to a sensing clock signal, wherein the output buffer outputs the carry signal and the scan signal based on any one of the scan clock signal, a first low potential power voltage, and a second low potential power voltage, a low level of the scan clock signal is set to be lower than or equal to the first low potential power voltage, and the second low potential power voltage is set to be lower than or equal to the low level of the scan clock signal.

2. The stage according to claim 1, wherein the output buffer comprises:

a tenth transistor connected between a scan clock terminal configured to receive the scan clock signal and a first output terminal configured to output the scan signal, and having a gate electrode connected to the eleventh node;

an eleventh transistor connected between the first output terminal and a first power terminal configured to receive the first low potential power voltage, and having a gate electrode connected to the twelfth node; and a twelfth transistor connected between a carry output terminal outputting the carry signal and the first output terminal, and having a gate electrode connected to the eleventh node.

3. The stage according to claim 2, wherein the twelfth transistor is turned on according to the voltage of the eleventh node and outputs a part of signals output to the first output terminal to the carry output terminal.

4. The stage according to claim 1, wherein the output buffer comprises:

a carry output buffer configured to output the carry signal based on the scan clock signal and the first low potential power voltage; and a scan output buffer configured to output the scan signal based on the scan clock signal and the second low potential power voltage.

5. The stage according to claim 4, wherein the low level of the scan clock signal is set to be lower than the first low potential power voltage, and the second low potential power voltage is set to be lower than the low level of the scan clock signal.

6. The stage according to claim 5, wherein the scan output buffer comprises:

a tenth transistor connected between a scan clock terminal configured to receive the scan clock signal and a first output terminal configured to output the scan signal, and having a gate electrode connected to the eleventh node; and an eleventh transistor connected between the first output terminal and a first power terminal configured to receive the first low potential power voltage, and having a gate electrode connected to the twelfth node, and the carry output buffer comprises:

a twelfth transistor connected between the scan clock terminal and a carry output terminal configured to output the carry signal, and having a gate electrode connected to the eleventh node; and a sixteenth transistor connected between the carry output terminal and the second low potential power voltage, and having a gate electrode connected to the twelfth node.

7. The stage according to claim 6, wherein the scan output buffer and the carry output buffer output the carry signal and the scan signal when the eleventh node is set to a high voltage.

8. The stage according to claim 6, wherein the output buffer further comprises a first transistor that is turned on when a fifth control signal is applied during a reset period of one frame and supplies the second low potential power voltage to the eleventh node.

9. The stage according to claim 8, wherein, when the low level of the scan clock signal is applied to the carry output terminal during a display period after the reset period, a first electrode voltage of the tenth transistor is set to the low level, a second electrode voltage is set to the first low potential power voltage, and a voltage of the gate electrode is set to the voltage of the eleventh node.

10. The stage according to claim 1, wherein the output buffer further comprises:

a twenty-sixth transistor connected between the first node and the eleventh node, and having a gate electrode connected to a second input terminal configured to receive a second control signal; and a twenty-seventh transistor connected between the second node and the twelfth node, and having a gate electrode connected to the second input terminal, and the twenty-sixth transistor and the twenty-seventh transistor are turned on by the second control signal and electrically connect the eleventh node and the twelfth node to the first node and the second node, respectively.

11. The stage according to claim 1, wherein the input unit comprises:

a twenty-first transistor connected between a second carry input terminal configured to receive the previous stage carry signal and a third node, and having a gate electrode connected to a first input terminal configured to receive the first control signal;

a twenty-second transistor connected between the third node and a third power terminal configured to receive a high potential power voltage, and having a gate electrode connected to a fourth node;

a twenty-third transistor connected between the third node and the fourth node, and having a gate electrode connected to the first input terminal;

a twenty-fourth transistor connected between the third power terminal and the first node, and having a gate electrode connected to the fourth node;

a twenty-fifth transistor connected between the fourth node and a second power terminal configured to receive the second low potential power voltage, and having a gate electrode connected to the fourth node; and a capacitor connected between the third power terminal and the fourth node.

12. The stage according to claim 11, wherein the twenty-first transistor, the twenty-second transistor, and the twenty-third transistor are turned on and supply a high voltage of the previous stage carry signal to the fourth node, when the first control signal is input.

13. The stage according to claim 12, wherein the twenty-fourth transistor supplies the high potential power voltage to the first node as the twenty-fourth transistor is turned on in response to a voltage of the fourth node, and the twenty-fifth transistor supplies the first low potential power voltage to the second node as the twenty-fifth transistor is turned on in response to the voltage of the fourth node.

14. A scan driver comprising stages connected to scan lines respectively and to supply a scan signal and a sensing signal to the scan lines, wherein an i-th (i is a natural number) stage comprises:

an input unit configured to control voltages of a first node and a second node based on a first control signal and a previous stage carry signal; and an output buffer including an eleventh node and a twelfth node electrically connected to the first node and the second node, respectively, in response to a second control signal, and configured to output a carry signal and the scan signal in response to a scan clock signal according to voltages of the eleventh node and the twelfth node and to output the sensing signal in response to a sensing clock signal, the output buffer outputs the carry signal and the scan signal based on any one of the scan clock signal, a first low potential power voltage, and a second low potential power voltage, a low level of the scan clock signal is set to be lower than or equal to the first low potential power voltage, and the second low potential power voltage is set to be lower than or equal to the low level of the scan clock signal.

15. The scan driver according to claim 14, wherein the output buffer comprises:

a tenth transistor connected between a scan clock terminal configured to receive the scan clock signal and a first output terminal configured to output the scan signal, and having a gate electrode connected to the eleventh node;

an eleventh transistor connected between the first output terminal and the first low potential power voltage, and having a gate electrode connected to the twelfth node; and a twelfth transistor connected between a carry output terminal configured to output the carry signal and the first output terminal, and having a gate electrode connected to the eleventh node.

16. The scan driver according to claim 15, wherein the twelfth transistor is turned on according to the voltage of the eleventh node and outputs a part of signals output to the first output terminal to the carry output terminal.

17. The scan driver according to claim 14, wherein the output buffer comprises:

a tenth transistor connected between a scan clock terminal configured to receive the scan clock signal and a first output terminal configured to output the scan signal, and having a gate electrode connected to the eleventh node;

an eleventh transistor connected between the first output terminal and the first low potential power voltage, and having a gate electrode connected to the twelfth node;

a twelfth transistor connected between the scan clock terminal and a carry output terminal configured to output the carry signal, and having a gate electrode connected to the eleventh node; and a sixteenth transistor connected between the carry output terminal and the second low potential power voltage, and having a gate electrode connected to the twelfth node.

18. The scan driver according to claim 17, wherein the low level of the scan clock signal is set to be lower than the first low potential power voltage, and the second low potential power voltage is set to be lower than the low level of the scan clock signal.

19. The scan driver according to claim 18, wherein the output buffer further comprises a first transistor that is turned on when a fifth control signal is applied during a reset period of one frame and supplies the second low potential power voltage to the eleventh node.

20. The scan driver according to claim 19, wherein, when the low level of the scan clock signal is applied to the carry output terminal during a display period after the reset period, a first electrode voltage of the tenth transistor is set to the low level, a second electrode voltage is set to the first low potential power voltage, and a voltage of the gate electrode is set to the voltage of the eleventh node.

* * * * *